US009989869B2

(12) United States Patent
Inoue et al.

(10) Patent No.: US 9,989,869 B2
(45) Date of Patent: Jun. 5, 2018

(54) TONER, TONER STORED UNIT, AND IMAGE FORMING APPARATUS

(71) Applicants: Daisuke Inoue, Shizuoka (JP); Naohiro Watanabe, Shizuoka (JP); Ryota Inoue, Shizuoka (JP); Masana Shiba, Shizuoka (JP); Junichi Awamura, Shizuoka (JP); Shingo Sakashita, Shizuoka (JP); Tomoki Murayama, Kanagawa (JP); Yoshitsugu Kimura, Kanagawa (JP); Rintaro Takahashi, Kanagawa (JP); Akio Takei, Shizuoka (JP)

(72) Inventors: Daisuke Inoue, Shizuoka (JP); Naohiro Watanabe, Shizuoka (JP); Ryota Inoue, Shizuoka (JP); Masana Shiba, Shizuoka (JP); Junichi Awamura, Shizuoka (JP); Shingo Sakashita, Shizuoka (JP); Tomoki Murayama, Kanagawa (JP); Yoshitsugu Kimura, Kanagawa (JP); Rintaro Takahashi, Kanagawa (JP); Akio Takei, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/541,053

(22) PCT Filed: Jan. 5, 2016

(86) PCT No.: PCT/JP2016/000026
§ 371 (c)(1),
(2) Date: Jun. 30, 2017

(87) PCT Pub. No.: WO2016/111424
PCT Pub. Date: Jul. 14, 2016

(65) Prior Publication Data

US 2018/0052403 A1 Feb. 22, 2018

(30) Foreign Application Priority Data

Jan. 5, 2015 (JP) ..... 2015-000403
Jun. 1, 2015 (JP) ..... 2015-111178
Nov. 16, 2015 (JP) ..... 2015-223973

(51) Int. Cl.
*G03G 9/087* (2006.01)
*G03G 9/08* (2006.01)
*G03G 9/093* (2006.01)

(52) U.S. Cl.
CPC ..... *G03G 9/0821* (2013.01); *G03G 9/08755* (2013.01); *G03G 9/08795* (2013.01);
(Continued)

(58) Field of Classification Search
CPC ..... G03G 9/08755
See application file for complete search history.

(56) References Cited

U.S. PATENT DOCUMENTS 5,968,701 A 10/1999 Onuma et al.
6,936,390 B2 8/2005 Nanya et al.
(Continued)

FOREIGN PATENT DOCUMENTS

EP 1 995 638 A1 11/2008
JP 10-087837 4/1998
(Continued)

OTHER PUBLICATIONS

International Search Report and Written Opinion Issued Feb. 23, 2016 for counterpart International Patent Application No. PCT/JP2016/000026 filed Jan. 5, 2016.
(Continued)

*Primary Examiner* — Hoa V Le
(74) *Attorney, Agent, or Firm* — Oblon, McClelland, Maier & Neustadt, L.L.P.

(57) ABSTRACT

A toner comprising a binder resin and a release agent, wherein the toner has a difference of 30 or less between a maximum value and a minimum value among peak intensities in a range of Molecular weight M±300 where Molecular weight M is a molecular weight selected from a range of from 300 through 5,000 in a molecular weight distribution of tetrahydrofuran (THF)-soluble components in the toner as measured by gel permeation chromatography (GPC), and wherein the peak intensities are defined as relative values assuming a maximum peak value in molecular weights of 20,000 or less is 100, in a molecular weight distribution curve taking an intensity as a vertical axis and a molecular weight as a horizontal axis as measured by GPC.

10 Claims, 7 Drawing Sheets

(52) U.S. Cl.
CPC ..... *G03G 9/09392* (2013.01); *G03G 9/08782* (2013.01); *G03G 9/08793* (2013.01)

(56) References Cited

U.S. PATENT DOCUMENTS 7,056,638 B1 6/2006 Tomita et al.
7,303,847 B2 12/2007 Tomita et al.
7,354,690 B2 4/2008 Ishii et al.
7,374,851 B2 5/2008 Nakayama et al.
7,435,521 B2 10/2008 Yagi et al.
7,449,273 B2 11/2008 Ohki et al.
7,459,255 B2 12/2008 Tanaka et al.
7,504,188 B2 3/2009 Yamada et al.
7,531,279 B2 5/2009 Watanabe et al.
8,026,031 B2 9/2011 Watanabe et al.
8,263,302 B2 9/2012 Moriya et al.
8,367,293 B2 2/2013 Ohtani et al.
8,603,718 B2 12/2013 Suzuki et al.
8,673,528 B2 3/2014 Sugimoto et al.
8,735,037 B2 5/2014 Yamashita et al.
8,778,588 B2 7/2014 Kusahara et al.
8,835,086 B2 9/2014 Watanabe et al.
8,877,420 B2 11/2014 Tanaka et al.
8,911,924 B2 12/2014 Sato et al.
9,023,570 B2 5/2015 Shiba et al.
9,069,288 B2 6/2015 Kojima et al.
9,134,638 B2 9/2015 Sakashita et al.
9,152,084 B2 10/2015 Shiba et al.
2002/0146631 A1 10/2002 Nakamura et al.
2003/0027074 A1 2/2003 Emoto et al.
2003/0134220 A1 7/2003 Emoto et al.
2003/0138717 A1 7/2003 Yagi et al.
2003/0152859 A1 8/2003 Emoto et al.
2003/0162112 A1 8/2003 Yamashita et al.
2004/0131961 A1 7/2004 Watanabe et al.
2004/0142264 A1 7/2004 Tanaka et al.
2004/0146795 A1 7/2004 Emoto et al.
2004/0175641 A1 9/2004 Nanya et al.
2004/0209181 A1 10/2004 Higuchi et al.
2004/0229147 A1 11/2004 Higuchi et al.
2004/0265721 A1 12/2004 Matsuoka et al.
2005/0003291 A1 1/2005 Takada et al.
2005/0026066 A1 2/2005 Tanaka et al.
2005/0031980 A1 2/2005 Inoue et al.
2005/0042534 A1 2/2005 Tanaka et al.
2005/0112488 A1 5/2005 Yamada et al.
2005/0164112 A1 7/2005 Ohki et al.
2005/0180786 A1 8/2005 Yamada et al.
2005/0186498 A1 8/2005 Honda et al.
2005/0277044 A1 12/2005 Watanabe et al.
2005/0277045 A1 12/2005 Saito et al.
2006/0024097 A1 2/2006 Yamada et al.
2006/0057488 A1 3/2006 Inoue et al.
2006/0068312 A1 3/2006 Yamashita et al.
2006/0099529 A1 5/2006 Tanaka et al.
2006/0160011 A1 7/2006 Inoue et al.
2006/0210903 A1 9/2006 Ohki et al.
2006/0240349 A1 10/2006 Watanabe et al.
2006/0269860 A1 11/2006 Nanya et al.
2007/0031752 A1 2/2007 Watanabe et al.
2007/0042284 A1 2/2007 Takada et al.
2007/0054210 A1 3/2007 Ohki et al.
2007/0059626 A1 3/2007 Inoue et al.
2007/0141500 A1 6/2007 Sugimoto et al.
2007/0141506 A1 6/2007 Inoue et al.
2007/0218380 A1 9/2007 Uchinokura et al.
2007/0218381 A1 9/2007 Uchinokura et al.
2007/0218382 A1 9/2007 Emoto et al.
2007/0218392 A1 9/2007 Yamada et al.
2007/0259283 A1 11/2007 Abe et al.
2008/0063972 A1 3/2008 Inoue et al.
2008/0069616 A1 3/2008 Kojima et al.
2008/0070144 A1 3/2008 Nagatomo et al.
2008/0070148 A1 3/2008 Awamura et al.
2008/0076055 A1 3/2008 Sawada et al.
2008/0138734 A1 6/2008 Inoue et al.
2008/0213682 A1 9/2008 Saitoh et al.
2008/0226998 A1 9/2008 Ishii et al.
2008/0227018 A1 9/2008 Awamura et al.
2008/0233495 A1 9/2008 Ishii et al.
2008/0233505 A1 9/2008 Nagatomo et al.
2008/0268366 A1 10/2008 Nakayama et al.
2008/0280218 A1 11/2008 Sabu et al.
2008/0280219 A1 11/2008 Nakayama et al.
2008/0280224 A1 11/2008 Inoue et al.
2008/0292361 A1 11/2008 Seshita et al.
2008/0311500 A1 12/2008 Yamada et al.
2008/0318144 A1 12/2008 Watanabe et al.
2009/0010687 A1 1/2009 Yamada et al.
2009/0017392 A1 1/2009 Higuchi et al.
2009/0061345 A1 3/2009 Yamada et al.
2009/0074467 A1 3/2009 Seshita et al.
2009/0092917 A1 4/2009 Sugimoto et al.
2009/0104555 A1 4/2009 Wakamatsu et al.
2009/0117480 A1 5/2009 Yamada et al.
2009/0142094 A1 6/2009 Sawada et al.
2009/0142680 A1 6/2009 Shimota et al.
2009/0142682 A1 6/2009 Saitoh et al.
2009/0142690 A1 6/2009 Awamura et al.
2009/0162770 A1 6/2009 Sako et al.
2009/0186292 A1 7/2009 Inoue et al.
2009/0202935 A1 8/2009 Moriya et al.
2009/0214973 A1 8/2009 Sugimoto et al.
2009/0214975 A1 8/2009 Awamura et al.
2009/0226836 A1 9/2009 Uchinokura et al.
2009/0233204 A1 9/2009 Watanabe et al.
2009/0269692 A1 10/2009 Awamura et al.
2009/0280421 A1 11/2009 Awamura et al.
2009/0325099 A1 12/2009 Watanabe et al.
2010/0035170 A1 2/2010 Sugimoto et al.
2010/0062352 A1 3/2010 Kusahara et al.
2010/0075243 A1 3/2010 Shimota et al.
2010/0075245 A1 3/2010 Watanabe et al.
2010/0081075 A1 4/2010 Watanabe et al.
2010/0104965 A1 4/2010 Inoue et al.
2010/0129748 A1 5/2010 Inoue et al.
2010/0183967 A1 7/2010 Sabu et al.
2010/0209838 A1 8/2010 Kusahara et al.
2010/0216068 A1 8/2010 Kotsugai et al.
2010/0233609 A1 9/2010 Higuchi et al.
2010/0310980 A1 12/2010 Sugimoto et al.
2010/0330489 A1 12/2010 Inoue et al.
2011/0003244 A1 1/2011 Inoue et al.
2011/0033794 A1 2/2011 Watanabe et al.
2011/0045398 A1 2/2011 Sekikawa et al.
2011/0065033 A1 3/2011 Uchinokura et al.
2011/0065036 A1 3/2011 Inoue et al.
2011/0076610 A1 3/2011 Ogawa et al.
2011/0076612 A1 3/2011 Awamura et al.
2011/0086308 A1 4/2011 Watanabe et al.
2011/0104608 A1 5/2011 Nakajima et al.
2011/0124838 A1 5/2011 Kotsugai et al.
2011/0129773 A1 6/2011 Shu et al.
2011/0151370 A1 6/2011 Shitara et al.
2011/0151372 A1 6/2011 Watanabe et al.

(56) References Cited

U.S. PATENT DOCUMENTS

2011/0200929 A1 8/2011 Karato et al.
2011/0223530 A1 9/2011 Inoue et al.
2011/0223532 A1 9/2011 Sugimoto et al.
2011/0255899 A1 10/2011 Iwamoto et al.
2011/0262853 A1 10/2011 Watanabe et al.
2011/0262856 A1 10/2011 Sugimoto et al.
2011/0281213 A1 11/2011 Sakashita et al.
2011/0294058 A1 12/2011 Shiba et al.
2011/0305986 A1 12/2011 Ogawa et al.
2011/0318053 A1 12/2011 Yamashita et al.
2012/0052431 A1 3/2012 Hozumi et al.
2012/0052434 A1 3/2012 Sugimoto et al.
2012/0064445 A1 3/2012 Kojima et al.
2012/0064447 A1 3/2012 Hozumi et al.
2012/0082926 A1 4/2012 Suzuki et al.
2012/0122027 A1 5/2012 Watanabe et al.
2012/0189951 A1 7/2012 Sugimoto et al.
2012/0219896 A1 8/2012 Asahina et al.
2012/0288299 A1 11/2012 Uchinokura et al.
2012/0288791 A1 11/2012 Sakashita et al.
2012/0295193 A1 11/2012 Hanatani et al.
2012/0328976 A1 12/2012 Seki et al.
2013/0011778 A1 1/2013 Yamashita et al.
2013/0017480 A1 1/2013 Suzuki et al.
2013/0022371 A1* 1/2013 Kusahara ..... G03G 9/08755 399/252
2013/0059247 A1 3/2013 Sugimoto et al.
2013/0095422 A1 4/2013 Yamamoto et al.
2013/0130171 A1 5/2013 Watanabe et al.
2013/0157183 A1 6/2013 Santo et al.
2013/0157184 A1 6/2013 Sugimoto et al.
2013/0157185 A1 6/2013 Sakashita et al.
2013/0157193 A1* 6/2013 Moritani ..... G03G 9/08728 430/109.4
2013/0164669 A1 6/2013 Yamashita et al.
2013/0171554 A1 7/2013 Yamashita et al.
2013/0171557 A1 7/2013 Watanabe et al.
2013/0177846 A1 7/2013 Watanabe et al.
2013/0196260 A1 8/2013 Yoshida et al.
2013/0196261 A1 8/2013 Uchinokura et al.
2013/0196263 A1 8/2013 Asahina et al.
2013/0224648 A1* 8/2013 Honda ..... G03G 9/0804 430/109.4
2013/0236826 A1 9/2013 Makabe et al.
2013/0236827 A1 9/2013 Yoshida et al.
2013/0243488 A1 9/2013 Kojima et al.
2013/0244154 A1 9/2013 Yamamoto et al.
2013/0244155 A1 9/2013 Satoh et al.
2013/0244156 A1 9/2013 Kojima et al.
2013/0244157 A1 9/2013 Inoue et al.
2013/0244158 A1 9/2013 Awamura et al.
2013/0252158 A1 9/2013 Yamada et al.
2013/0316280 A1 11/2013 Yoshida et al.
2013/0330522 A1 12/2013 Suzuki et al.
2014/0072349 A1 3/2014 Sakashita et al.
2014/0080046 A1* 3/2014 Asahina ..... G03G 9/0821 430/105
2014/0080047 A1 3/2014 Takahashi et al.
2014/0093820 A1 4/2014 Satoh et al.
2014/0140731 A1 5/2014 Hozumi et al.
2014/0220485 A1 8/2014 Kojima et al.
2014/0234767 A1 8/2014 Awamura et al.
2014/0242514 A1 8/2014 Inoue et al.
2014/0272689 A1 9/2014 Yamashita et al.
2014/0272695 A1 9/2014 Moritani et al.
2014/0301757 A1 10/2014 Sakashita et al.
2014/0363209 A1 12/2014 Inoue et al.
2015/0024311 A1 1/2015 Kikawa et al.
2015/0024312 A1* 1/2015 Shiba ..... G03G 9/0821 430/107.1
2015/0037718 A1 2/2015 Morita et al.
2015/0104739 A1 4/2015 Nagatomo et al.
2015/0198902 A1 7/2015 Saito et al.
2015/0220011 A1 8/2015 Miyaake et al.
2015/0227071 A1 8/2015 Sakashita et al.
2015/0234303 A1 8/2015 Moriya et al.
2015/0234304 A1 8/2015 Nagata et al.
2015/0241804 A1 8/2015 Takahashi et al.
2015/0253687 A1 9/2015 Chiba et al.
2015/0261111 A1 9/2015 Inoue et al.
2015/0261144 A1 9/2015 Sakashita et al.
2015/0362852 A1 12/2015 Moriya et al.
2016/0357121 A1 12/2016 Kikawa et al.

FOREIGN PATENT DOCUMENTS

JP 2002-082484 3/2002
JP 2003-280271 10/2003
JP 2004-004691 1/2004
JP 2004-151439 5/2004
JP 4118498 7/2008
JP 4156759 7/2008
JP 4565054 8/2010
JP 4993533 5/2012
WO WO 2013/058407 A1 4/2013
WO WO 2013/137335 A1 9/2013

OTHER PUBLICATIONS

Extended European Search Report issued Nov. 7, 2017 in Patent Application No. 16734984.4.

* cited by examiner

[Fig. 1A]
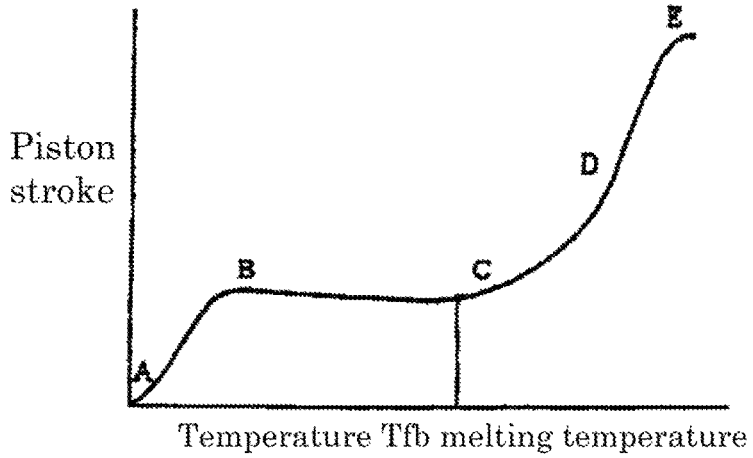
[Fig. 1B]
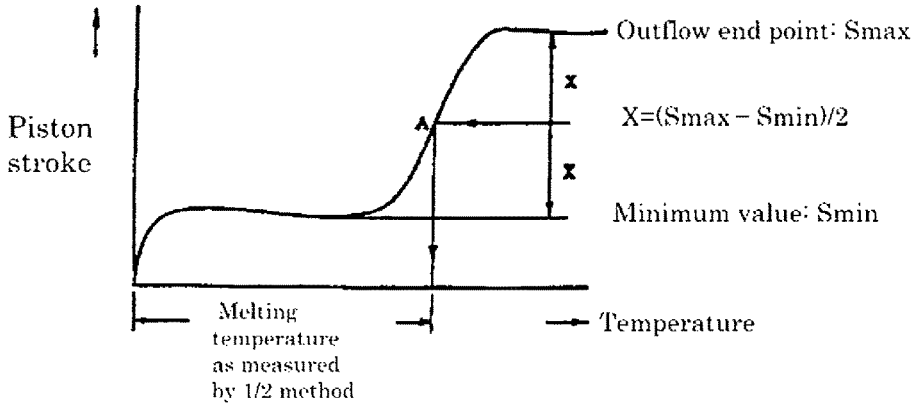
[Fig. 2]
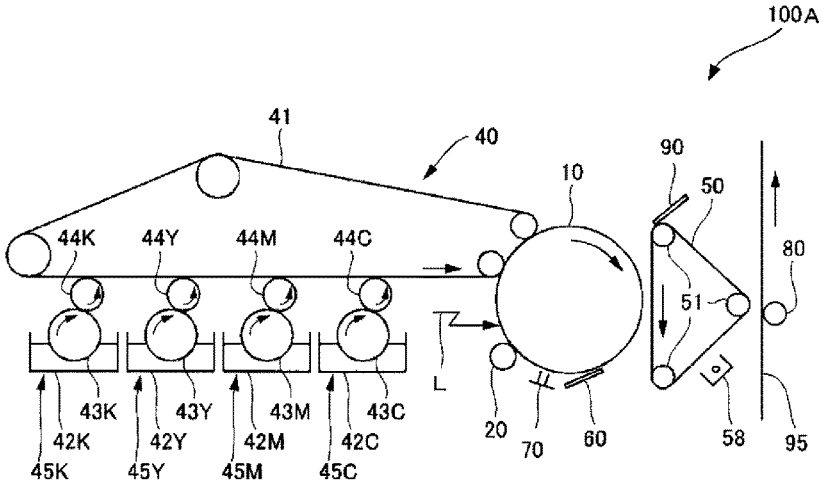

[Fig. 3]
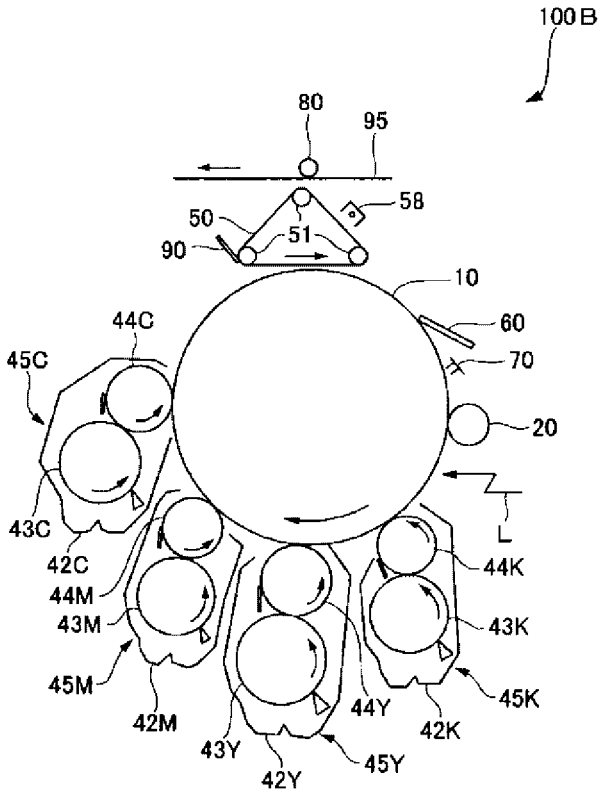

[Fig. 4]
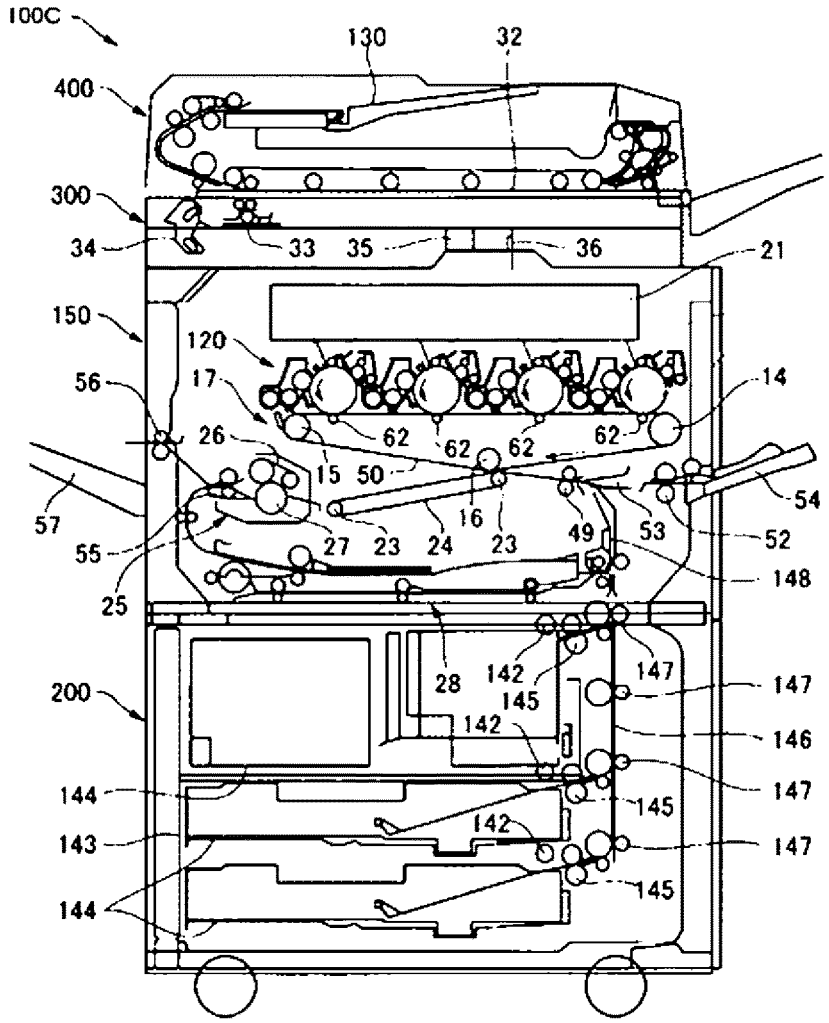
[Fig. 5]
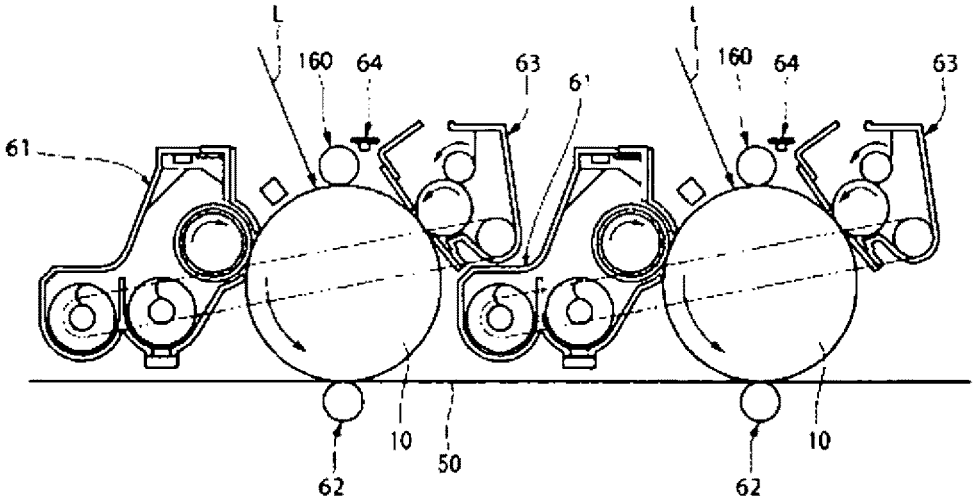

[Fig. 6]
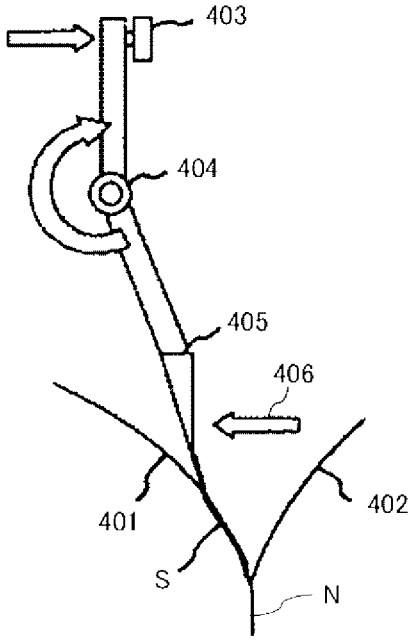
[Fig. 7]
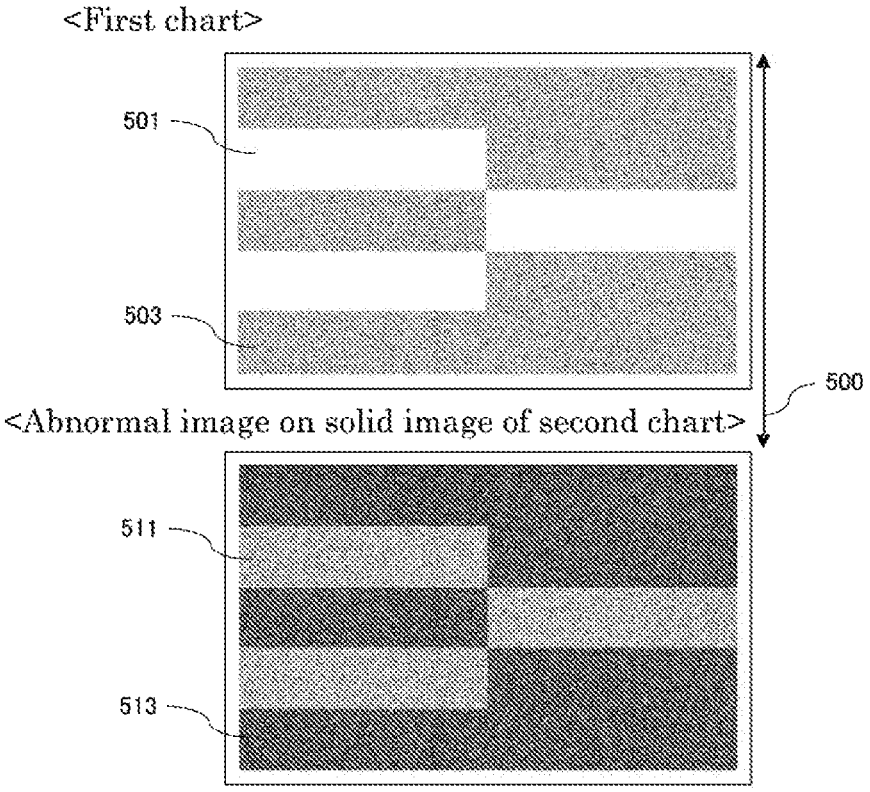

[Fig. 8]
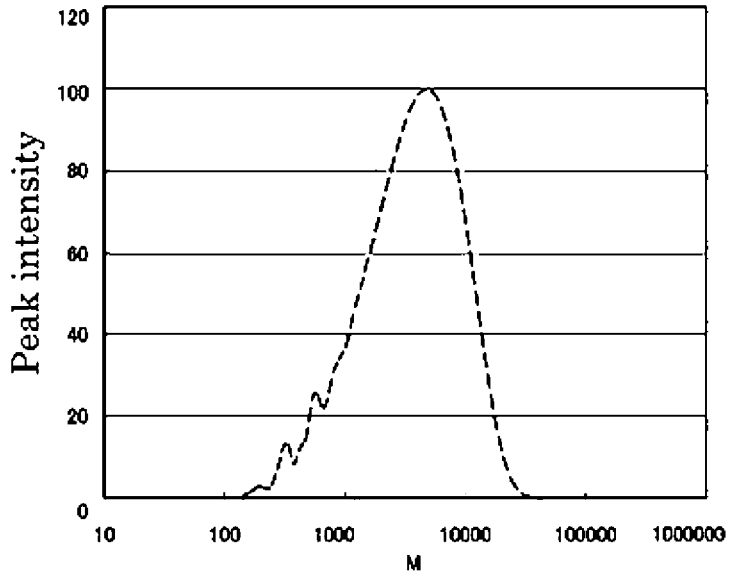
[Fig. 9]
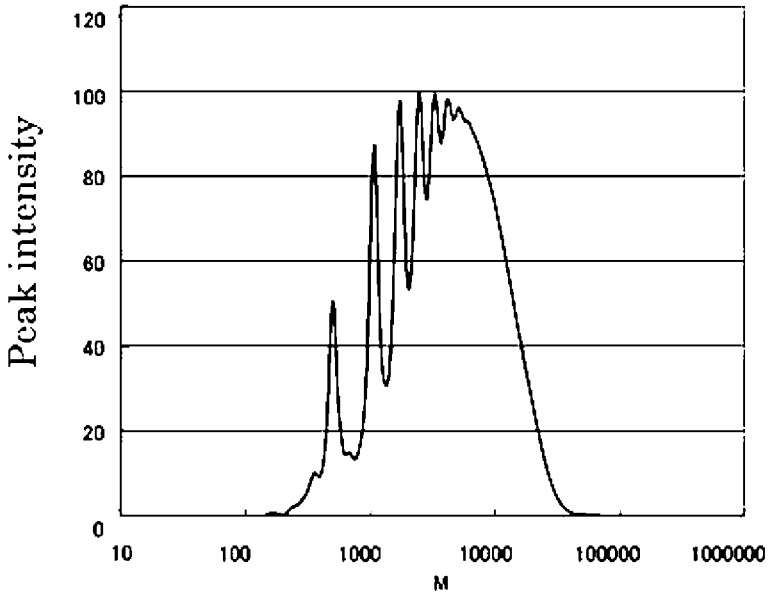

[Fig. 10]
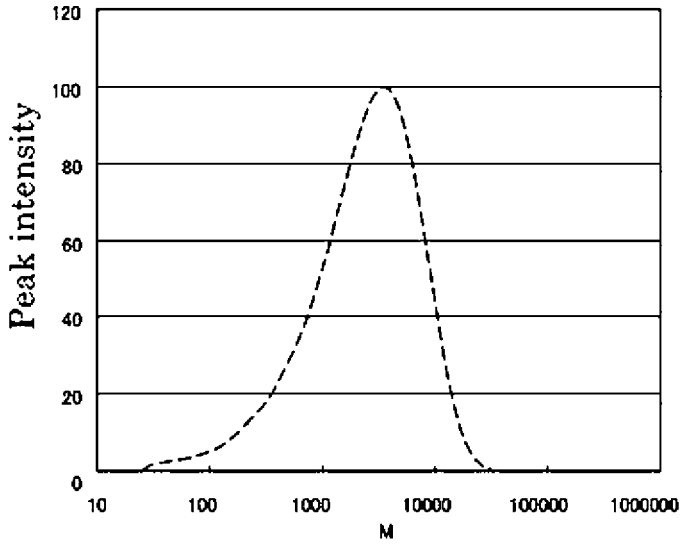
[Fig. 11]
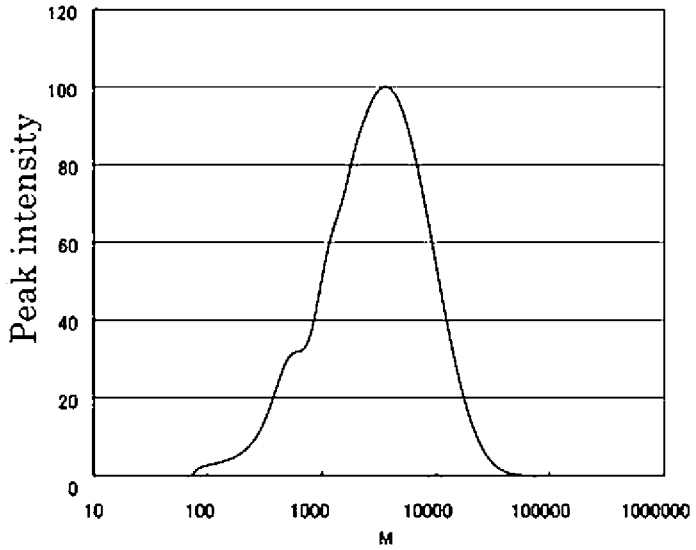

[Fig. 12]
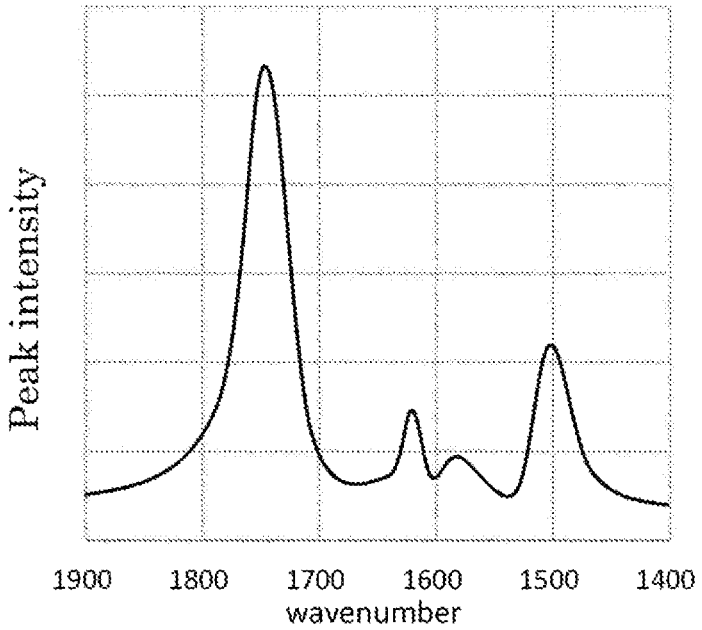
[Fig. 13]
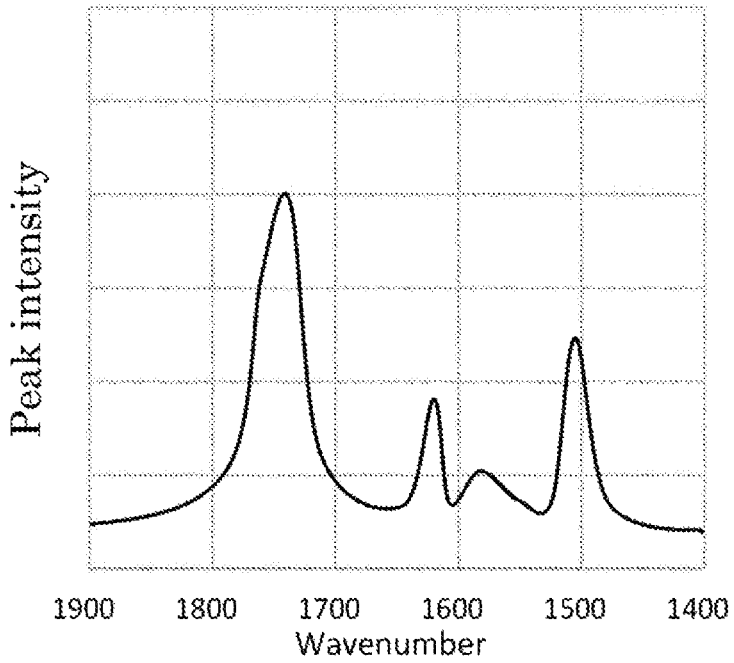

TONER, TONER STORED UNIT, AND IMAGE FORMING APPARATUS

TECHNICAL FIELD

The present disclosure relates to toners, toner stored units, and image forming apparatuses.

BACKGROUND ART

In electrophotographic image formation, an electrostatic image (latent image) is formed on an electrostatic latent image bearer, and developed with a charged toner conveyed by a developer carrier to form a toner image. The toner image is then transferred onto a recording medium (e.g., paper), and fixed with, for example, heating to obtain an output image. There has been known that the toner remaining on the electrostatic latent image bearer after the toner image is transferred is recovered from the electrostatic latent image bearer by a cleaning member and discharged to a waste toner container.

An image forming apparatus employing a heat-fixing system requires much electricity in the process of heat-melting the toner to be fixed on a recording medium (e.g., paper). Therefore, from the viewpoint of energy saving, low temperature fixing property is one of important properties of the toner. Stable charging property and heat resistant storability are also important in order to continuously output images with a certain level of quality even in a severe use condition, for example, in which temperature or humidity in a use environment of the image forming apparatus varies or in which a large number of images are continuously output.

For the purpose of improving the low temperature fixing property of the toner, it is necessary to control a molecular weight, a molecular weight distribution, and a thermal property of a binder resin that is a main component of the toner. For example, PTL 1 has suggested a toner that contains at least two types of different resins of which softening points are different by 25° C. or more, and chloroform-insoluble components in a range of from 5% by mass through 40% by mass. Each of the resins has a main peak in a range of from 1,000 through 10,000 in a molecular weight distribution of tetrahydrofuran (THF)-soluble components as measured by gel permeation chromatography (GPC). The molecular weight distribution has a half value width of 15,000 or less. The above toner exhibits excellent low temperature fixing property, hot-offset resistance, and heat resistant storability.

However, the binder resin is decreased in the molecular weight, so that low molecular-weight components are increased. The low molecular-weight components contaminate a surface of a charging member or a carrier, or absorb moisture under high humidity. This disadvantageously causes the toner to deteriorate in charging stability.

Meanwhile, for the purpose of improving the charging stability of the toner, the following methods generally have been believed to be effective: a method in which a hydrophobic additive is externally added to surfaces of toner particles to thereby suppress charging reduction of the toner under high humidity, a method in which toner components causing charging reduction of the toner under high humidity are removed, or a method in which contamination resistance of toner components against a charging member or a carrier is improved.

For example, PTL 2 has suggested that low molecular weight components can be prevented from giving an unpleasant odor or contaminating a device by adjusting a content rate of components having a molecular weight in a range of from 500 through 1,000 and derived from a binder resin and a content rate of components having a molecular weight of 500 or less and derived from a binder resin in the toner as measured by GPC. PTL 3 has suggested that low molecular weight components can be prevented from contaminating a developing member by adjusting a ratio of components having a molecular weight of 500 or less in the binder resin as measured by GPC.

However, in the above suggestions, the low molecular-weight components that are effective for the low temperature fixing property are actively removed, leading to a greatly deteriorated low temperature fixing property.

PTL 4 has suggested that both of the low temperature fixing property and storability can be achieved by defining a glass transition temperature of a toner at a predetermined heating rate as measured by DSC, and that the charging stability of a toner can be improved by defining a relationship between an absorbance and a concentration of a solution of the toner in ethyl acetate at a predetermined wavelength, composition of a polyester resin serving as a binder resin, and an acid value and a hydroxyl value of the resin, to thereby decrease amounts of hygroscopic components on surface of toner particles and of hygroscopic components derived from the binder resin.

However, also in this suggestion, the low molecular-weight components that are effective for the low temperature fixing property are removed, so that satisfactory low temperature fixing property is not achieved. Additionally, acid dimers and acid trimers both of which have a molecular weight in a range of from about 1,000 through about 2,000 and both of which deteriorate the charging stability are not taken into account. As a result, satisfactory charging stability has been not achieved.

Thus, there is trade-off among the low temperature fixing property, the heat resistant storability, the charging stability. At present, there has not been achieved a toner being satisfactory in all of the above properties.

CITATION LIST

Patent Literature

PTL 1: Japanese Patent (JP-B) No. 4118498
PTL 2: JP-B No. 4156759
PTL 3: JP-B No. 4993533
PTL 4: JP-B No. 4565054

SUMMARY OF INVENTION

Technical Problem

The present invention has been made in view of the foregoing problems, and aims to provide a toner being excellent in all of low temperature fixing property, heat resistant storability, and charging stability.

Solution to Problem

To solve the above existing problems, the present invention provides a toner including a binder resin and a release agent. The toner has a difference of 30 or less between the maximum value and the minimum value among peak intensities defined below in a range of Molecular weight M±300 where Molecular weight M is a molecular weight selected from a range of from 300 through 5,000 in a molecular weight distribution of tetrahydrofuran (THF)-soluble components in the toner as measured by gel permeation chromatography (GPC). The peak intensity is defined as a relative value assuming the maximum intensity value in molecular weights of 20,000 or less is 100, in a molecular weight distribution curve taking an intensity as a vertical axis and a molecular weight as a horizontal axis as measured by GPC.

Advantageous Effects of Invention

According to the present invention, a toner being excellent in all of low temperature fixing property, heat resistant storability, and charging stability can be provided.

BRIEF DESCRIPTION OF DRAWINGS

FIG. 1A is one exemplary flow-curve of a toner as measured with an elevated flowtester.

FIG. 1B is one exemplary flow-curve of a toner as measured with an elevated flowtester.

FIG. 2 is a schematic diagram illustrating one exemplary image forming apparatus according to the present invention.

FIG. 3 is a schematic diagram illustrating another exemplary image forming apparatus according to the present invention.

FIG. 4 is a schematic diagram illustrating another exemplary image forming apparatus according to the present invention.

FIG. 5 is a schematic diagram illustrating another exemplary image forming apparatus according to the present invention.

FIG. 6 is a schematic explanatory diagram illustrating one exemplary measurement device of pressing force of a recording medium used for evaluating separation stability of a toner.

FIG. 7 is a schematic diagram illustrating one exemplary evaluation chart for evaluating gloss unevenness.

FIG. 8 is a graph illustrating one exemplary GPC measurement result of tetrahydrofuran (THF)-soluble components in one exemplary toner according to the present invention.

FIG. 9 is a graph illustrating one exemplary GPC measurement result of THF-soluble components in a toner according to a related art.

FIG. 10 is a graph illustrating another exemplary GPC measurement result of THF-soluble components in one exemplary toner according to the present invention.

FIG. 11 is a graph illustrating another exemplary GPC measurement result of THF-soluble components in a toner according to a related art.

FIG. 12 is a graph illustrating one exemplary infrared absorption spectrum of one exemplary toner.

FIG. 13 is a graph illustrating one exemplary infrared absorption spectrum of another exemplary toner.

DESCRIPTION OF EMBODIMENTS

A toner, a toner stored unit, and an image forming apparatus according to the present invention will now be described referring to figures. Notably, the present invention is not limited to the below described embodiments and can be changed within the scope that those skilled in the art can conceive. For example, other embodiments, addition, modification, or deletion may be made. Any of the aspects is within the scope of the present invention as long as operation and effect of the present invention are realized thereby.

(Toner)

A toner of the present invention includes a binder resin and a release agent. The toner has a difference of 30 or less between the maximum value and the minimum value among peak intensities defined below in a range of Molecular weight M±300 where Molecular weight M is a molecular weight selected from a range of from 300 through 5,000 in a molecular weight distribution of tetrahydrofuran (THF)-soluble components in the toner as measured by gel permeation chromatography (GPC). The peak intensity is defined as a relative value assuming the maximum intensity value in molecular weights of 20,000 or less is 100, in a molecular weight distribution curve taking an intensity as a vertical axis and a molecular weight as a horizontal axis as measured by GPC.

The details will be described below.

In order to improve the low temperature fixing property of the toner, it is necessary to lower the viscosity of the toner in a low temperature range. In the present invention, in order to achieve the low temperature fixing property, the toner has preferably the weight average molecular weight Mw of 10,000 or lower in a molecular weight distribution of tetrahydrofuran (THF)-soluble components in the toner. When the weight average molecular weight Mw of higher than 10,000, the viscosity of the toner is insufficiently lowered in a low temperature range, so that the low temperature fixing property is likely to be inhibited.

Meanwhile, in order to improve the charging stability under high humidity and the heat resistant storability of the toner, it is necessary to decrease components having low thermal property or having high hygroscopy and contained in the toner. Conventionally, in order to improve the heat resistant storability and the charging stability, there has been attempted to decrease a content rate of components having a molecular weight in a range of from 500 through 1,000 and derived from a binder resin and a content rate of components having a molecular weight of 500 or less and derived from a binder in the toner as measured by GPC.

However, the present inventors conducted studies to fix a toner in a low temperature range by lowering the molecular weight of the binder resin, and have found that it is insufficient just to decrease the low molecular-weight components as described above. Additionally, the present inventors have been found that the charging stability under high humidity and the heat resistant storability are deteriorated in the case where components having certain molecular weights are detected as many peaks in a molecular weight distribution of THF-soluble components as measured by GPC.

The reason why this occurs is not well understood, but is believed as follows. For each peak, components in a certain peak form a domain. This causes unevenness of toner properties, resulting in deterioration of the charging stability under high humidity and the heat resistant storability. Meanwhile, lowering the molecular weight of the binder resin makes the toner be susceptible to be deformed by heat or mechanical pressure. Additionally, low molecular-weight components in the toner are increased to contaminate a surface of a charging member or a carrier, or absorb moisture under high humidity, leading to deterioration of the charging stability of the toner.

The present inventors have been made in view of the foregoing problem, and conducted extensive studies. As a result, the present inventors have been found that it is important for the toner to have a difference of 30 or less between the maximum value and the minimum value among peak intensities in a range of Molecular weight M±300 where Molecular weight M is a molecular weight selected from a range of from 300 through 5,000 in a molecular weight distribution of THF-soluble components in the toner as measured by GPC. This makes it possible to achieve the low temperature fixing property due to lowered viscosity of the binder resin and to effectively prevent the heat resistant storability and the charging stability from deteriorating.

In the case where the toner has the difference of 30 or more between the maximum value and the minimum value among peak intensities in the range of Molecular weight M±300, the difference corresponds to a peak mainly found in a low molecular weight region. The peak found in a low molecular weight region of the molecular weight distribution is due to low molecular-weight components mainly derived from raw materials. For example, in the case of the binder resin, the low molecular-weight components are derived from unreacted residual monomer or oligomer (e.g., dimers or trimers) contained in the binder resin.

The difference of 30 or more between the maximum value and the minimum value among peak intensities indicates that the low molecular-weight components contained in the toner in a large amount. The low molecular-weight components are likely to be melted by external heat, and, therefore, easily softened by heat generated from a device in use or heat generated during storage. This is why the toner containing the low molecular-weight components in a large amount is poor in the heat resistant storability and the toner particles are easily aggregated with each other by heat.

Additionally, the low molecular-weight components also are easily deformed by external pressure and easily adhere to a carrier or a developing member. In the case of using, as a developer, a toner containing the low molecular-weight components in a large amount, the low molecular-weight components adhere to a carrier or a developing member after use for a long period of time or under a high temperature and high humidity environment, causing the charging property to significantly deteriorate over time.

According to the present invention, the low temperature fixing property can be achieved, and the heat resistant storability and the charging stability can be effectively prevented from deteriorating. Appropriate control of the low molecular-weight components can improve contamination resistance. According to the present invention, the toner can be improved in the separation stability, and can achieve both of the separation stability and high gloss.

The toner of the present invention has a difference of 30 or less between the maximum value and the minimum value among peak intensities in a range of Molecular weight M±300 where Molecular weight M is a molecular weight selected from a range of from 300 through 5,000 in a molecular weight distribution of THF-soluble components in the toner as measured by GPC. This can be achieved by, for example, the following method, but is not limited thereto: a method in which a terminal hydrophilic group in the binder resin is replaced with a lipophilic group, or a method in which a resin synthesis reaction is accelerated. The method in which a terminal hydrophilic group in the binder resin is replaced with a lipophilic group is not particularly limited, but, for example, a method in which a terminal hydroxyl group is replaced with phenoxyacetic acid or benzoic acid may be used. The method in which a resin synthesis reaction is accelerated is not particularly limited, but, for example, a method in which a monomer is removed by increasing the degree of decompression through a reaction at a high temperature for a long period of time may be used.

A molecular weight distribution of THF-soluble components in the toner as measured by GPC is determined as follows.

Gel permeation chromatography (GPC) measuring device: GPC-8220GPC (manufactured by Tosoh Corporation)

Column: TSK-GEL SUPER HZ 2000, TSK-GEL SUPER HZ 2500, and TSK-GEL SUPER HZ 3000

Temperature: 40° C.

Solvent: THF

Flow rate: 0.35 mL/min

Sample: THF sample solution having a concentration adjusted to 0.15% by mass

Pretreatment of sample: a toner is dissolved in THF (containing a stabilizer, manufactured by Wako Pure Chemical Industries, Ltd.) at 0.15% by mass, followed by filtering through a 0.45 μm filter. The resultant filtrate is used as the sample.

The measurement can be performed by injecting a range of from 10 μL through 200 μL of the THF sample solution. As for the measurement of the molecular weight of the sample, a molecular weight distribution of the sample is calculated from the relationship between the number of counts and the logarithmic value of the calibration curve prepared from several monodispersed polystyrene standard samples.

As for the polystyrene standard sample for preparing the calibration curve, for example, TSK standard polystyrenes having molecular weights of 37,200, 6,200, 2,500, and 589 (manufactured by Tosoh Corporation) and standard polystyrenes and toluenes having molecular weights of 28,400, 20,298, 10,900, 4,782, 1,689, and 1,309 (manufactured by SHOWA DENKO K.K.) are used. As for a detector, a refractive index (RI) detector is used.

For the GPC measurement results, a molecular weight distribution curve was plotted by taking an intensity as a vertical axis and a molecular weight as a horizontal axis, and peak intensities throughout the molecular weight distribution curve were corrected assuming the maximum peak intensity in molecular weights of 20,000 or less is 100. The difference between the maximum value and the minimum value among peak intensities is calculated by subtracting the minimum value from the maximum value in a range of Molecular weight M±300 in the resultant molecular weight distribution curve.

Selection of a column is important in the GPC measurement of THF-soluble components in a toner according to the present invention. The result is presented in FIG. 8 in the case where the above described columns were used to measure "a toner having a difference of 30 or less between the maximum value and the minimum value among peak intensities defined below (the definition is omitted) in a range of Molecular weight M±300 where Molecular weight M is a molecular weight selected from a range of from 300 through 5,000 in a molecular weight distribution of tetrahydrofuran (THF)-soluble components in the toner as measured by GPC" (Toner A). Meanwhile, the result from a conventional toner that is outside the scope of the present invention (Toner B) is presented in FIG. 9. As can be seen from FIGS. 8 and 9, the difference between the maximum value and the minimum value is 30 or less for the Toner A, but more than 30 for the Toner B.

On the other hand, the results are presented in FIGS. 10 and 11 in the case where three "TSK-GEL SUPER HZM-H" columns connected in series were used for the measurement instead of the above described "Column: TSK-GEL SUPER HZ 2000, TSK-GEL SUPER HZ 2500, and TSK-GEL SUPER HZ 3000" (manufactured by Tosoh Corporation). FIG. 10 represents the result from Toner A, and FIG. 11 represents the result from Toner B. In this case, difference was not found between the Toner A and the conventional Toner B. Thus, selection of a column is important.

In the present invention, a toner extract obtained by drying an extraction liquid obtained through Soxhlet extraction of the toner with THF preferably has a glass transition temperature Tg in a range of from 40° C. through 60° C., a weight average molecular weight Mw in a range of from 3,000 through 10,000 in a molecular weight distribution as measured by GPC, and a ratio of the weight average molecular weight (Mw) to a number average molecular weight (Mn) of 6 or less.

The toner extract obtained by drying an extraction liquid obtained through Soxhlet extraction of the toner with THF more preferably has the glass transition temperature Tg in a range of from 42° C. through 50° C., the weight average molecular weight Mw in a range of from 3,500 through 5,000 in a molecular weight distribution as measured by GPC, and the ratio of the weight average molecular weight (Mw) to a number average molecular weight (Mn) of 2.5 or less.

The glass transition temperature of the toner extract is preferably a range of from 40° C. through 60° C. The Tg of lower than 40° C. deteriorates storability of the resulting toner in a high temperature high humidity environment, causing a problem such as solidification, aggregation, or charging reduction due to surface changes. The Tg of higher than 60° C. may deteriorate the low temperature fixing property of the resulting toner. The glass transition temperature of the toner extract is more preferably a range of from 42° C. through 50° C.

A method for obtaining the toner extract will now be described. Two grams of the toner is placed in a thimble having an internal diameter of 24 mm, which is then set in an extraction tube. A flask is charged with 200 mL of THF, followed by performing Soxhlet extraction for 10 hours. As for the Soxhlet extraction, a commonly used Soxhlet extractor can be used. One set of the flask equipped with a condenser is placed in a heating mantle. The THF is allowed to reflux at 80° C. and added dropwise from the condenser to the toner so that the THF-soluble components in the toner are extracted in the flask, to thereby obtain an extraction liquid. The extraction liquid is dried to obtain a toner extract. Note that, a temperature or duration of the drying is not particularly limited, and can be appropriately changed.

In the present invention, the Tg of the toner can be measured using, for example, a differential scanning calorimeter (e.g., DSC-6220R, manufactured by Seiko Instruments Inc.).

Specifically, a sample is heated from room temperature to 150° C. at a temperature rising rate of 10° C./min; left to stand at 150° C. for 10 min; cooled to room temperature; left to stand at room temperature for 10 min; and then heated again to 150° C. at a temperature rising rate of 10° C./min. The Tg can be determined from the base line at a temperature equal to or lower than the glass transition temperature and a curved line portion at a height which corresponds to 1/2 of the distance from the base line at a temperature equal to or lower than the glass transition temperature to the base line at a temperature equal to or higher than the glass transition temperature.

In the molecular weight distribution of the toner extract as measured by GPC, the weight average molecular weight Mw is preferably a range of from 3,000 through 10,000. The weight average molecular weight Mw of lower than 3,000 may deteriorate the heat resistant storability. Additionally, low molecular-weight components in the toner are increased to contaminate a surface of a charging member or a carrier, or absorb moisture under high humidity, easily leading to deterioration of charging stability of the toner. The weight average molecular weight Mw of higher than 10,000 increase elasticity of the toner during fixing, potentially inhibiting the low temperature fixing property. The weight average molecular weight Mw is more preferably a range of from 3,500 through 5,000.

In the molecular weight distribution of the toner extract as measured by GPC, a ratio of the weight average molecular weight (Mw) to the number average molecular weight (Mn) (weight average molecular weight (Mw)/number average molecular weight (Mn), hereinafter may be simply referred to as Mw/Mn) is preferably 6 or less, more preferably 2.5 or less.

In the present invention, the Mw/Mn of 6 or less is important from the viewpoint of achieving both of the low temperature fixing property and the heat resistant storability. The molecular weight distribution of the toner extract as measured by GPC refers to a molecular weight distribution of the binder resin. Narrowing the distribution can provide a hot melt property in which viscosity is rapidly decreased around a fixing starting temperature (sharp meltability) to the toner, making it possible to design a toner having both of good heat resistant storability and low temperature fixing property. The Mw/Mn of higher than 6 may deteriorate not only the low temperature fixing property but also the heat resistant storability.

In the toner of the present invention, the toner extract obtained by drying an extraction liquid obtained through Soxhlet extraction of the toner with THF preferably has an acid value AV in a range of from 5 KOHmg/g through 20 KOHmg/g and a hydroxyl value of 20 KOHmg/g or less. The acid value AV of less than 5 KOHmg/g represents low polarity of the toner. This decreases affinity to paper, potentially leading to poor low temperature fixing property. In the case of producing the toner through aqueous granulation, the low polarity causes excessively low wettability with water, potentially leading to deterioration of granulability. In the case where the acid value AV is higher than 20 KOHmg/g, high polarity leads to low humidity resistance, so that satisfactory storability or charging stability may not be achieved under high temperature and high humidity. In the case where the hydroxyl value OHV is higher than 20 KOHmg/g, the thermal property is deteriorated by the action of moisture in an environment of high temperature and high humidity, potentially leading to deterioration of the heat resistant storability.

The gel content refers to a content of ethyl-acetate insoluble components obtained through Soxhlet extraction with ethyl acatate. The ethyl-acetate insoluble components can be controlled depending on the weight average molecular weight Mw or the degree of cross-linking of the binder resin. A method for controlling increase or decrease of the gel content is not particularly limited. For example, a method in which an amount of a resin having high Mw and degree of cross-linking contained in a toner is adjusted or a method in which a resin is reacted in a toner to thereby increase the Mw and the degree of cross-linking may be used.

The ethyl acetate insoluble components obtained through Soxhlet extraction of the toner of the present invention with ethyl acetate is preferably a range of from 10% by mass through 30% by mass, more preferably a range of from 12% by mass through 23% by mass. In the case where the ethyl acetate insoluble components fall within the above described preferable range, deterioration of the separation stability due to excessive decrease of viscosity can be prevented, while keeping low viscosity effective for high gloss and the low temperature fixing property. This makes it possible to design a toner having all of good low temperature fixing property, gloss property, and separation stability.

One exemplarily Soxhlet extraction method of the toner with ethyl acatate will be described. A commonly used Soxhlet extractor can be used for the Soxhlet extraction. Firstly, 0.5 g of a toner is weighed precisely into a thimble for Soxhlet extraction which has been weighed precisely, 200 g of ethyl acetate is added into a 300 mL flat-bottom flask, and the thimble is placed in a Soxhlet extraction tube. The flat-bottom flask, the Soxhlet extraction tube, and a cooling pipe are coupled to each other. The flat-bottom flask is heated in a mantle heater to thereby perform extraction for 10 hours from the beginning of boiling of the ethyl acetate in the flask. After the extraction, the thimble is washed with ethyl acetate thoroughly, and then the ethyl acetate serving as a solvent is dried thoroughly. The amount of ethyl-acetate insoluble components contained in the toner is calculated in percentage from the initial sample weight, the initial thimble weight, and the extraction residue after extraction and drying. Notably, temperature and time are not particularly limited and may be varied appropriately.

A 1/2 method softening point (T1/2) of the toner will now be described. From the viewpoint of the granulability (e.g., control of particle diameter distribution or control of particle shape), in the case of producing the toner by the below described ester elongation method, it is important to allow the 1/2 method softening point (T1/2) of the toner to fall within an appropriate range for the purpose of achieving both of the separation stability and the high gloss of the toner. In the present invention, in the case where the toner is obtained through the ester elongation method, the toner has preferably the 1/2 method softening point (T1/2) in a range of from 105° C. through 125° C. in a flow curve of the toner as measured with an elevated flowtester.

In the case where the toner has the difference of 30 or less between the maximum value and the minimum value among peak intensities in a range of Molecular weight M±300 where Molecular weight M is a molecular weight selected from a range of from 300 through 5,000 in a molecular weight distribution of THF-soluble components in the toner as measured by GPC, which is characteristic of the present invention, and where the toner is produced through the ester elongation method, a range which provides both of the separation stability and the high gloss of the toner is different from that of conventional toners.

This is believed to be because as follows. It is believed that a major factor for controlling meltability of the toner in the ester elongation method is the degree of elongation reaction of prepolymer. However, in the toner meeting the above described condition of the molecular weight distribution, the content of the low molecular-weight components derived from raw materials is reduced, which is greatly different from conventional one. As a result, the progression of elongation reaction of the prepolymer or properties of the resultant elongation product become different from conventional one.

The 1/2 method softening point (T1/2) is preferably a range of from 105° C. through 125° C., more preferably a range of from 110° C. through 120° C. The 1/2 method softening point (T1/2) of 105° C. or higher is preferable since separation resistance of the toner can be adjusted to an appropriate range and good separation stability can be ensured. The 1/2 method softening point (T1/2) of 125° C. or lower is preferable since the glossiness of the toner can be kept at a high level. The above described preferable range can achieve both of good separation stability and high gloss.

Examples of a method for controlling the 1/2 method softening point (T1/2) of the toner include a method in which a molecular weight or an amount of a binder resin precursor containing a functional group reactive with an active-hydrogen group (reactive-group containing prepolymer) is adjusted, and a method in which a temperature or time when an active-hydrogen group containing compound is reacted with the reactive-group containing prepolymer to thereby elongate in a toner producing step is adjusted.

The 1/2 method softening point (T1/2) of the toner can be measured by an appropriately selected method. For example, the 1/2 method softening point (T1/2) can be determined from a flow curve measured with an elevated flowtester (CFT-500, manufactured by SHIMADZU CORPORATION). One exemplary flow curve is illustrated in FIGS. 1A and 1B. The melting temperature as measured by 1/2 method in FIG. 1B denotes the T1/2 temperature. One exemplary measurement condition is as follows.

<Measurement Condition>

Load: 10 kg/cm$^2$

Heating rate: 3.0° C./min

Diameter of die: 0.50 mm

Length of die: 1.0 mm

Measurement temperature: from 40° C. through 200° C.

For the viscoelasticity of the toner, tan δ, which is a ratio (G"/G') of the storage modulus G' (Pa) to the loss viscosity G" (Pa) is preferably a range of from 0.40 through 1.00, more preferably a range of from 0.50 through 0.90 in a measurement temperature range of from 120° C. through 160° C. The tan δ of 0.40 or more is preferable since good glossiness can be achieved in a fixed image. The tan δ of 1.00 or less is preferable since gloss unevenness can be prevented from occurring.

The gloss unevenness refers to image abnormality in which gloss is not uniform over the fixed image, that is, gloss is high in some regions but low in others. This is especially important in the field of product printing in which high-quality and high-gloss images are demanded. The gloss unevenness occurs via a variety of mechanisms. For example, due to adhesion and accumulation of the release agent on a fixing member, a previous image pattern history appears on a following image as the gloss unevenness.

FIG. 7 is a schematic explanatory diagram of gloss unevenness. FIG. 7 represents an image chart in the case where a solid image is printed immediately after a previous image including an image portion 503 and a non-image portion 501. The upper diagram represents the first chart, and the lower diagram represents the second chart, indicating that an abnormal image is occurred in the solid image of the second chart. In this figure, the reference numeral 500 denotes a perimeter of a fixing belt, the reference numeral 501 denotes the non-image portion, the reference numeral 503 denotes the image portion, the reference numeral 511 denotes an evaluation portion (1), and the reference numeral 513 denotes an evaluation portion (2).

The release agent is adhered on the fixing member in the image portion 503 of the previous image, but not in the non-image portion 501. Therefore, the previous image pattern history remains on the fixing member as adhesion of the release agent. Upon fixing the following solid image, the history causes a difference in an amount of the release agent on the image. A region to which a large amount of the release agent adheres has excessively high releasability and relatively high gloss (Evaluation portion (2) 513). In contrast, a region to which a small amount of the release agent adheres has normal or, in some cases, insufficient releasability and relatively low gloss (Evaluation portion (1) 511). This causes the difference in gloss.

In addition, roughness of a surface of the image may appear as the gloss unevenness on the image due to the hot-offset resistance of the toner. A temperature applied on a sheet of paper or an image during fixing is varied in accordance with the previous image pattern. The more an amount of the toner disposed on the previous image is, the more heat is lost from the fixing member. Poor hot-offset resistance of the toner roughens the surface of the image a higher temperature portion, leading to low gloss. In contrast, the surface of the image is less roughened in a lower temperature portion, leading to high gloss. This causes the difference in gloss.

The tan δ of the toner can be measured with a dynamic viscoelasticity measuring device (e.g., ARES, manufactured by TA instruments). Specifically, a sample is molded into a pellet having a diameter of 8 mm and a thickness in a range of from 1 mm through 2 mm. Then, the resultant pellet is fixed on a parallel plate having a diameter of δ mm, stabilized at 40° C., and heated to 200° C. at a frequency of 1 Hz (6.28 rad/s), a strain amount of 0.1% (controlled strain mode), and a heating rate of 2.0° C./min.

A method for controlling the tan δ of the toner is not particularly limited. For example, a method described regarding to the method for controlling the gel content, a method in which compatibility between low molecular-weight components and high molecular weight components in the binder resin is adjusted, and a method in which compatibility between a core portion and a shell portion of a core-shell toner is adjusted may be used.

A ratio ($P_{urethane}/P_{urea}$) of a peak height due to C═O stretching vibration derived from a urethane bond ($P_{urethane}$) to a peak height due to C═O stretching vibration derived from a urea bond ($P_{urea}$) of the toner is preferably a range of from 9.0 through 23.0, more preferably a range of from 10.0 through 15.0. The $P_{urethane}/P_{urea}$ of higher than 23.0 may deteriorate the hot-offset resistance, and the $P_{urethane}/P_{urea}$ of lower than 9.0 may deteriorate the low temperature fixing property.

A resin containing a high proportion of urea bonds is more excellent in a waterproof property, solvent resistance, and heat resistance than a resin containing a high proportion of urethane bonds. In particular, due to its high thermal property, the resin containing a high proportion of urea bonds is excellent in the heat resistant storability and the hot-offset resistance. However, in the case where the proportion of the urea bonds is excessively high, the low temperature fixing property may be deteriorated.

The ratio of peak heights between a urethane bond and a urea bond in the toner can be determined from a spectrum through infrared spectroscopy. The infrared spectroscopy is a useful method for obtaining information about chemical bonds of a substance, and is a method including allowing infrared light (from 15,000 $cm^{-1}$ through 10 $cm^{1}$) to enter a sample and spectrally diffracting transmitted light, reflected light, and scattered light from the sample to thereby obtain an infrared (IR) spectrum. The method is simple and can be performed under room atmosphere, so that the method has been used in various fields. Wavelength regions to be measured are classified into a near infrared region (from 14,290 $cm^{-1}$ through 4,000 $cm^{-1}$), a mid-infrared region (from 4,000 $cm^{-1}$ through 400 $cm^{-1}$), and a far infrared region (from 700 $cm^{-1}$ through 200 $cm^{-1}$). Generally, the term infrared refers to the mid-infrared region. The mid-infrared region mainly provides information about chemical bonds (atomic group or functional group) of organics. For example, a peak due to stretching vibration of a C═O bond contained in the urethane bond is usually found at 1,720 $cm^{-1}$, and a peak due to stretching vibration of a C═O bond contained in the urea bond is usually found at 1,608 $cm^{-1}$.

The spectrum is measured by a Kbr method (full transmission method) with Fourier transform infrared spectrophotometer (Avatar 370, manufactured by Thermo Electron Corporation). In the present invention, the $P_{urethane}/P_{urea}$, where $P_{urethane}$ is a peak height (1,722 $cm^{-1}$) of the C═O bond contained in the urethane bond (baseline of height: from 1,658 $cm^{-1}$ through 1,777 $cm^{-1}$) and $P_{urea}$ is a peak height (1,610 $cm^{-1}$) of the C═O bond contained in the urea bond (baseline of height: from 1,591 $cm^{-1}$ through 1,636 $cm^{-1}$), is used as an intensity ratio.

A method for controlling the ratio ($P_{urethane}/P_{urea}$) of a peak height due to C═O stretching vibration derived from a urethane bond (P urethane) to a peak height due to C═O stretching vibration derived from a urea bond ($P_{urea}$) is not particular limited. Examples thereof includes a method in which an elongation and cross-linking reaction of an isocyanate-containing polyester prepolymer is regulated.

Exemplary spectra obtained through infrared spectroscopy are illustrated in FIGS. 12 and 13. FIG. 12 represents the case where the $P_{urethane}/P_{urea}$ falls within the preferable range, and FIG. 13 represents the case where the $P_{urethane}/P_{urea}$ does not fall within the preferable range.

A shape and a size of the toner are not particularly limited and may be appropriately selected depending on the intended purpose, but the toner preferably has the following average circularity, the following volume average particle diameter, and the following ratio of the volume average particle diameter to the number average particle diameter (volume average particle diameter/number average particle diameter).

The average circularity of the toner particles is a value obtained by dividing a perimeter of a circle that has the same projected area as a shape of the toner particle by a perimeter of an actual particle. The average circularity of the toner particles is preferably 0.950 to 0.980, more preferably 0.960 to 0.975. The toner particles having the average circularity of less than 0.95% is preferably 15% or less.

When the average circularity of the toner particles is less than 0.950, transferability to be satisfied and an image having high quality and having no dust particles may not be obtained. In an image forming system employing blade cleaning, the toner particles having an average circularity of more than 0.980 may cause cleaning failure on a photoconductor and on a transfer belt, and may cause fog on an image, such as background fog that is caused by accumulating the residual toner after transfer. The residual toner after transfer remains on the photoconductor when an untransferred image is formed due to paper feeding failure, for example, in cases where an image having high image area rate such as a photographic image is formed. Alternatively, the toner particles having an average circularity of more than 0.980 may pollute, for example, a charging roller configured to charge a photoconductor in a contact manner, which results in degradation of original charging ability.

The average circularity can be measured by, for example, a flow type particle image analyzer ("FPIA-2100", product of SYSMEX CORPORATION), and analysis can be performed using an analysis software (FPIA-2100, Data Processing Program for FPIA version 00-10).

Specifically, a 10% by mass surfactant (alkyl benzene sulfonate, NEOGEN SC-A, product of DKS Co. Ltd.) (0.1 mL to 0.5 mL) is added to a 100 mL-glass beaker, and each toner (0.1 g to 0.5 g) is added thereto. Then, the mixture is stirred by a micro-spatula, followed by adding 80 mL of ion-exchanged water thereto. The thus-obtained dispersion liquid is subjected to the dispersion treatment for 3 minutes by an ultrasonic wave disperser (HONDA ELECTRONICS CO., LTD.). A concentration of the dispersion liquid is adjusted to 5,000 particles/mL to 15,000 particles/mL, and a shape and a distribution of the dispersion liquid are measured using the FPIA-2100.

In the measuring method of the present invention, it is important that a concentration of the dispersion liquid is adjusted to 5,000 particles/μL to 15,000 particles/μL in terms of measurement reproducibility of the average circularity. In order to obtain the aforementioned concentration of the dispersion liquid, it is necessary to change conditions of the dispersion liquid (i.e., an amount of the surfactant to be added to the dispersion liquid, and an amount of the toner. Similar to the measurement of the ptoner particle diameter, a requisite amount of the surfactant is different depending on hydrophobicity of the toner. When the surfactant is excessively added to the dispersion liquid, the resultant toner contains foam, which may cause noise. When the surfactant is slightly added the dispersion liquid, it does not wet the toner, and thus dispersion may be insufficient. An amount of the toner added is different depending on a particle diameter. When the particle diameter is small, an amount of the surfactant may be slightly added to the dispersion liquid. When the particle diameter is large, it is necessary to excessively add the surfactant to the dispersion liquid. When the toner particle diameter is 3 mm to 10 mm, a concentration of the dispersion liquid can be adjusted to a range of from 5,000 particles/μL through 15,000 particles/μL by adding a range of from 0.1 g through 0.5 g of the surfactant to the dispersion liquid.

A volume average particle diameter of the toner is not particularly limited and may be appropriately selected depending on the intended purpose, but it is preferably a range of from 3 μm through 10 μm, more preferably a range of from 4 μm through 7 μm. When the volume average particle diameter is less than 3 μm, the resultant two-component developer may cause fusion of the toner particles on the surface of the carrier during stirring for a long term in a developing device, which results in reduction of charging ability of the carrier. When the volume average particle diameter is more than 10 μm, the resultant two-component developer makes it difficult to obtain an image having high resolution and high quality, which may lead to large fluctuation of particle diameters when the toner is supplied and consumed.

A ratio of the volume average particle diameter to the number average particle diameter (volume average particle diameter/number average particle diameter) is preferably a range of from 1.00 through 1.25, more preferably a range of from 1.00 through 1.15.

The volume average particle diameter, and the ratio of the volume average particle diameter to the number average particle diameter (volume average particle diameter/number average particle diameter) can be measured by a particle size determination apparatus ("Multisizer III", product of Beckman Coulter, Inc.) with an aperture of 100 μm, and can be analyzed by an analysis software (Beckman Coulter Mutlisizer 3 Version 3.51).

Specifically, a 10% by mass surfactant (alkyl benzene sulfonate, NEOGEN SC-A, product of DKS Co. Ltd.) (0.5 mL) is added to a 100 mL-glass beaker, and each of the toners (0.5 g) is added to the beaker. Then, the mixture is stirred by a micro-spatula, followed by adding 80 mL of ion-exchanged water thereto. The obtained dispersion liquid is subjected to the dispersion treatment for 10 minutes by an ultrasonic wave disperser (W-113MK-II, product of HONDA ELECTRONICS CO., LTD.). The dispersion liquid can be measured by the Multisizer III using ISOTON III (product of Beckman Coulter, Inc.) as a measurement solution.

The toner sample dispersing liquid is added dropwise thereto so that a concentration of the toner indicated by the device is 8±2%. In the measurement of the present invention, it is important to adjust the concentration of the toner to 8±2% in terms of measurement repeatability of the particle diameter. There is no accidental error so long as the concentration of the toner falls within the aforementioned range.

<Toner Materials>

A toner of the present invention contains toner base particles containing at least a binder resin and a release agent, further contains other components if necessary. Also, an external additive can be added to the toner base particles if necessary.

<<Binder Resin>>

The binder resin is not particularly limited and may be appropriately selected depending on the intended purpose. Examples of the binder resin include a polyester resin, a silicone resin, a styrene•acryl resin, a styrene resin, an acryl resin, an epoxy resin, a diene resin, a phenol resin, a terpene resin, a coumarin resin, an amide-imide resin, a butyral resin, a urethane resin, and an ethylene-vinyl acetate resin. These may be used alone or in combination thereof. Among them, a polyester resin and a resin obtained by combining a polyester resin with the aforementioned another binder resin are preferable because the resultant toner is excellent in low temperature fixing ability, and has enough flexibility even if the toner particles have lower molecular weight.

—Polyester Resin—

The polyester resin is not particularly limited and may be appropriately selected depending on the intended purpose. Examples of the polyester resin include an unmodified polyester resin and a modified polyester resin. These may be used alone or in combination thereof.

—Unmodified Polyester Resin—

The unmodified polyester resin is not particularly limited and may be appropriately selected depending on the intended purpose. Examples of the unmodified polyester resin include a crystalline polyester resin, and a resin obtained by reacting polyol represented by the following General Formula (1) and polycarboxylic acid represented by the following General Formula (2) to form polyester.

(Chem. 1)

$$A—[OH]_m \qquad \text{General Formula (1)}$$

$$B—[COOH]_n \qquad \text{General Formula (2)}$$

Here, in the General Formula (1), A represents an alkyl group having 1 through 20 carbon atoms, an alkylene group having 1 through 20 carbon atoms, an aromatic group that may have a substituent, or a heterocyclic aromatic group that may have a substituent, and m represents an integer of 2 to 4.

In the General Formula (2), B represents an alkyl group having 1 through 20 carbon atoms, an alkylene group having 1 through 20 carbon atoms, an aromatic group that may have a substituent, or a heterocyclic aromatic group that may have a substituent, and n represents an integer of a range of from 2 through 4.

A polyol represented by the General Formula (1) is not particularly limited and may be appropriately selected depending on the intended purpose. Examples of the polyol represented by the General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylolethane, trimethylolpropane, 1,3,5-trihydroxy methylbenzene, bisphenol A, bisphenol A ethylene oxide adduct, bisphenol A propylene oxide adduct, hydrogenated bisphenol A, hydrogenated bisphenol A ethylene oxide adduct, and hydrogenated bisphenol A propylene oxide adduct. These may be used alone or in combination thereof.

The polycarboxylic acid represented by the General Formula (2) is not particularly limited and may be appropriately selected depending on the intended purpose. Examples of the polycarboxylic acid represented by the General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra(methylene carboxyl)methane, 1,2,7,8-octanetetra carboxylic acid, pyromellitic acid, empol trimer acid, cyclohexane dicarboxylic acid, cyclohexene dicarboxylic acid, butane tetracarboxylic acid, diphenylsulphone tetracarboxylic acid, and ethylene glycol bis(trimellitic acid). These may be used alone or in combination thereof.

—Modified Polyester Resin—

The modified polyester resin is not particularly limited and may be appropriately selected depending on the intended purpose. Examples of the modified polyester resin include a resin obtained reacting an active hydrogen group-containing compound with polyester that can react with the active hydrogen group-containing compound (hereinafter, referred to as "polyester prepolymer") through the elongation reaction and/or the cross-linking reaction. The elongation reaction and/or the cross-linking reaction can be terminated by a reaction terminator (diethylamine, dibutylamine, butylamine, laurylamine, and a product obtained by blocking monoamine such as a ketimine compound) if necessary.

—Active Hydrogen Group-Containing Compound—

The active hydrogen group-containing compound functions as a crosslinking agent and an elongating agent when the polyester prepolymer undergoes the elongation reaction and the cross-linking reaction in an aqueous medium.

The active hydrogen group-containing compound is not particularly limited and may be appropriately selected depending on the intended purpose, so long as it contains an active hydrogen group. Among them, amines are preferable because the polyester prepolymer is an isocyanate group-containing polyester prepolymer that will be described hereinafter, and thus toner particles having high molecular weight can be obtained.

The active hydrogen group is not particularly limited and may be appropriately selected depending on the intended purpose. Examples of the active hydrogen group include a hydroxyl group (alcoholic hydroxyl group or phenolic hydroxyl group), an amino group, a carboxyl group, and a mercapto group. These may be used alone or in combination thereof.

The amines that are the active hydrogen group-containing compound are not particularly limited and may be appropriately selected depending on the intended purpose. Examples of the amines that are the active hydrogen group-containing compound include diamine, trivalent or higher polyamine, amino alcohol, amino mercaptan, amino acid, and a product obtained by blocking an amino group of the aforementioned amines.

Examples of the diamine include aromatic diamine (phenylenediamine, di-ethyltoluene diamine, and 4,4'-diaminodiphenylmethane); alicyclic diamine (4,4'-diamino-3,3'-dimethyldicyclohexyl methane, diamine cyclohexane, and isophoronediamine); and aliphatic diamine (ethylene diamine, tetramethylene diamine, and hexamethylenediamine).

Examples of the trivalent or higher polyamine include diethylenetriamine and triethylene tetramine.

Examples of the amino alcohol include ethanol amine and hydroxyethyl aniline Examples of the amino mercaptan include aminoethyl mercaptan and aminopropyl mercaptan.

Examples of the amino acid include amino propionic acid and amino caproic acid.

Examples of the product obtained by blocking an amino group of the aforementioned amines include an oxazoline compound and a ketimine compound obtained by reacting any of the amines (e.g., diamine, trivalent or higher polyamine, amino alcohol, amino mercaptan, and amino acid) with ketones (e.g., acetone, methyl ethyl ketone, and methyl isobutyl ketone).

These may be used alone or in combination thereof. Among them, diamine, and a mixture of diamine and a small amount of trivalent or higher polyamine are particularly preferable as the amines.

—Polymer that can React with Active Hydrogen Group-Containing Compound—

A polymer that can react with an active hydrogen group-containing compound is not particularly limited and may be appropriately selected depending on the intended purpose, so long as it contains a group that can react with the active hydrogen group-containing compound. Among them, a polyester resin containing a urea bond-generating group (RMPE) is preferable, and an isocyanate group-containing polyester prepolymer is more preferable, because the resultant toner is excellent in high flowability during melting and transparency; the molecular weight of high molecular components is easy to control; and a dry toner is excellent in oilless low temperature fixing ability and releasability.

The isocyanate group-containing polyester prepolymer is not particularly limited and may be appropriately selected depending on the intended purpose. Examples of the isocyanate group-containing polyester prepolymer include a polycondensate obtained by reacting polyol with polycarboxylic acid and a product obtained by reacting the active hydrogen group-containing polyester resin with polyisocyanate.

The polyol is not particularly limited and may be appropriately selected depending on the intended purpose.

Examples of the polyol include: diols such as alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropylene glycol, polyethylene glycol, polypropylene glycol, and polytetramethylene ether glycol), alicyclic diols (e.g., 1,4-cyclohexane dimethanol and hydrogenated bisphenol A), bisphenols (e.g., bisphenol A, bisphenol F, and bisphenol S), adducts of the bisphenols with alkylene oxides (e.g., ethylene oxide, propylene oxide, and butylene oxide), and adducts of the alicyclic diol with alkylene oxide (e.g., ethylene oxide, propylene oxide, and butylene oxide); trivalent or more polyols such as polyvalent aliphatic alcohols (e.g., glycerin, trimethylolethane, trimethylolpropane, pentaerythritol, and sorbitol), trivalent or more phenols (e.g., phenol novolac, and cresol novolac), and adducts of trivalent or more polyphenol with alkylene oxide; and mixtures of diol and trivalent or more polyol.

These may be used alone or in combination thereof. Among them, the polyol is preferably the diol alone, or a mixture of the diol and a small amount of the trivalent or more polyol.

The diol is preferably alkylene glycol having 2 through 12 carbon atoms and alkylene oxide adducts of bisphenols (e.g., bisphenol A ethylene oxide 2 mole adduct, bisphenol A propylene oxide 2 mole adduct, and bisphenol A propylene oxide 3 mole adduct).

An amount of the polyol in the isocyanate group-containing polyester prepolymer is not particularly limited and may be appropriately selected depending on the intended purpose, but it is preferably a range of from 0.5% by mass through 40% by mass, more preferably a range of from 1% by mass through 30% by mass, still more preferably a range of from 2% by mass through 20% by mass. When the amount of the polyol in the isocyanate group-containing polyester prepolymer is less than 0.5% by mass, the resultant toner may be deteriorated in hot offset resistance, and may have difficulty in achieving both storage property and low temperature fixing ability. When the amount of the polyol in the isocyanate group-containing polyester prepolymer is more than 40% by mass, the resultant toner may be deteriorated in low temperature fixing ability.

The polycarboxylic acid is not particularly limited and may be appropriately selected depending on the intended purpose. Examples of the polycarboxylic acid include: alkylene dicarboxylic acid (e.g., succinic acid, adipic acid, and sebacic acid); alkenylene dicarboxylic acid (e.g., maleic acid and fumaric acid); aromatic dicarboxylic acid (e.g., terephthalic acid, isophthalic acid, and naphthalene dicarboxylic acid); and trivalent or more polycarboxylic acid (aromatic polycarboxylic acid having 9 through 20 carbon atoms such as trimellitic acid and pyromellitic acid). These may be used alone or in combination thereof.

Among them, the polycarboxylic acid is preferably alkenylene dicarboxylic acid having 4 through 20 carbon atoms or aromatic dicarboxylic acid having 8 through 20 carbon atoms. Note that, an anhydrate of polycarboxylic acid and lower alkylester (e.g., methyl eseter, ethylester, and isopropyl ester) can be used instead of the polycarboxylic acid.

A mixing ratio between the polyol and the polycarboxylic acid is not particularly limited and may be appropriately selected depending on the intended purpose. An equivalent ratio [OH]/[COOH] of the hydroxyl group [OH] in the polyol to the carboxyl group [COOH] in the polycarboxylic acid is preferably a range of from 2/1 through 1/1, more preferably a range of from 1.5/1 through 1/1, still more preferably a range of from 1.3/1 through 1.02/1.

The polyisocyanate is not particularly limited and may be appropriately selected depending on the intended purpose. Examples of the polyisocyanate include: aliphatic polyisocyanate (e.g., tetramethylene diisocyanate, hexamethylene diisocyanate, 2,6-diisocyanato methylcaproate, octamethylene diisocyanate, decamethylene diisocyanate, dodecamethylene diisocyanate, tetradecamethylene diisocyanate, trimethylhexane diisocyanate, and tetramethylhexane diisocyanate); alicyclic polyisocyanate (e.g., isophorone diisocyanate and cyclohexylmethane diisocyanate); aromatic diisocyanate (e.g., tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenylether-4,4'-diisocyanate); aromatic aliphatic diisocyanate (e.g., a,a,a',a'-tetramethyl xylylene diisocyanate); isocyanurates (tris-isocyanatoalky-isocyanurate and triisocyanato cycloalkyl-isocyanurate); phenol derivatives of any of the aforementioned compounds; and a product obtained by blocking, for example, oxime or caprolactam. These may be used alone or in combination thereof.

A mixing ratio between the polyisocyanate and the active hydrogen group-containing polyester resin (hydroxyl group-containing polyester resin) is not particularly limited and may be appropriately selected depending on the intended purpose. An equivalent ratio [NCO]/[OH] of the isocyanate group [NCO] in the polyisocyanate to the hydroxyl group [OH] in the hydroxyl group-containing polyester resin is preferably a range of from 5/1 through 1/1, more preferably a range of from 4/1 through 1.2/1, particularly preferably a range of from 3/1 through 1.5/1. When the equivalent ratio [NCO]/[OH] is less than 1/1, an amount of the urea in the polyester becomes low, and thus the resultant toner may be deteriorated in offset resistance. When the equivalent ratio [NCO]/[OH] is more than 5/1, the resultant toner may be deteriorated in low temperature fixing ability.

An amount of the polyisocyanate in the isocyanate group-containing polyester prepolymer is not particularly limited and may be appropriately selected depending on the intended purpose. The amount of the polyisocyanate in the isocyanate group-containing polyester prepolymer is preferably a range of from 0.5% by mass through 40% by mass, more preferably a range of from 1% by mass through 30% by mass, particularly preferably a range of from 2% by mass through 20% by mass. When the amount of the polyisocyanate in the isocyanate group-containing polyester prepolymer is less than 0.5% by mass, the resultant toner may be deteriorated in hot offset resistance, and may have difficulty in achieving both storage property and low temperature fixing ability. When the amount of the polyisocyanate in the isocyanate group-containing polyester prepolymer is more than 40% by mass, the resultant toner may be deteriorated in low temperature fixing ability.

An average number of the isocyanate group per one molecule of the isocyanate group-containing polyester prepolymer is preferably 1 or more, more preferably a range of from 1.2 through 5, still more preferably a range of from 1.5 through 4. When the average number of the isocyanate group per one molecule of the isocyanate group-containing polyester prepolymer is less than 1, a molecular weight of the polyester resin modified with the urea bond-generating group (RMPE) is low, and thus the resultant toner may be deteriorated in hot offset resistance.

A mixing ratio between the isocyanate group-containing polyester prepolymer and the amines is not particularly limited and may be appropriately selected depending on the intended purpose. A mixing equivalent ratio [NCO]/[NHx]

of the isocyanate group [NCO] in the isocyanate group-containing polyester prepolymer to the amino group [NHx] in the amines is preferably a range of from 1/3 through 3/1, more preferably a range of from 1/2 through 2/1, particularly preferably a range of from 1/1.5 through 1.5/1. When the mixing equivalent ratio ([NCO]/[NHx]) is less than 1/3, the resultant toner may be deteriorated in low temperature fixing ability. When the mixing equivalent ratio ([NCO]/[NHx]) is more than 3/1, a molecular weight of the urea-modified polyester resin is low, and thus the resultant toner may be deteriorated in hot offset resistance. The urethane bond may contain in the polyester in which a urea bond is modified. A ratio between the urea bond and the urethane bond is not particularly limited and may be appropriately selected depending on the intended purpose.

—Method for Synthesizing Polymer that can React with Active Hydrogen Group-Containing Compound—

A method for synthesizing the polymer that can react with an active hydrogen group-containing compound is not particularly limited and may be appropriately selected depending on the intended purpose.

In cases where the isocyanate group-containing polyester prepolymer is produced, for example, a method for synthesizing the isocyanate group-containing polyester prepolymer is follows: the polyol and the polycarboxylic acid are heated to 150° C. to 280° C. in the presence of a known esterification catalyst (e.g., titanium tetrabutoxide or dibutyltin oxide), to obtain a hydroxyl group-containing polyester while reducing pressure in necessary for removing water; and the hydroxyl group-containing polyester is allowed to react with the polyisocyanate at 40° C. to 140° C., to obtain an isocyanate group-containing polyester prepolymer.

A weight average molecular weight (Mw) of the polymer that can react with an active hydrogen group-containing compound is not particularly limited and may be appropriately selected depending on the intended purpose. The weight average molecular weight of the polymer that can react with an active hydrogen group-containing compound is preferably a range of from 3,000 through 40,000, more preferably a range of from 4,000 through 30,000 in a molecular weight distribution obtained by measuring tetrahydrofuran (THF) soluble matter of the toner by GPC (gel permeation chromatography). When the weight average molecular weight (Mw) of the polymer that can react with an active hydrogen group-containing compound is less than 3,000, the resultant toner may be deteriorated in storage property. When the weight average molecular weight (Mw) of the polymer that can react with an active hydrogen group-containing compound is more than 40,000, the resultant toner may be deteriorated in low temperature fixing ability.

Measurement of the weight average molecular weight (Mw) can be performed as follows: First, a column is stabilized in a heat chamber at 40° C. Tetrahydrofuran (THF) as a column solvent is allowed to flow into the column at a velocity of 1 mL/min at 40° C. A tetrahydrofuran sample solution of a resin (50 mL to 200 mL) obtained by adjusting a concentration of the sample to 0.05% by mass to 0.6% by mass is charged into the column, followed by performing measurement. In the measurement of the molecular weight of the sample, the molecular weight distribution of the sample is determined based on the relationship between the logarithmic value and the number of counts of the calibration curve given by using several monodisperse polystyrene-standard samples.

The standard polystyrene samples used for giving the calibration curve are standard polystyrene samples having a molecular weight of 6'10, $2.1'10^2$, $4'10^2$, $1.75'10^4$, $1.1'10^5$, $3.9'10^5$, $8.6'10^5$, $2'10^6$, and $4.48'10^6$ (these products are Pressure Chemical Co. or Tosoh Corporation), and at least about 10 standard polystyrene samples are preferably used. Note that, as the detector, a refractive index (RI) detector can be used.

<<Release Agent>>

The release agent is not particularly limited and may be appropriately selected depending on the intended purpose. Examples of the release agent include: waxes such as a vegetable wax (e.g., carnauba wax, cotton wax, Japan wax, and rice wax), an animal wax (e.g., bees wax and lanolin), a mineral wax (e.g., ozokelite and ceresine), and a petroleum wax (e.g., paraffin, microcrystalline, and petrolatum); waxes other than the above natural waxes such as a synthetic hydrocarbon wax (e.g., Fischer-Tropsch wax and polyethylene wax) and a synthetic wax (e.g., ester wax, ketone, and ether); fatty acid amides such as 1,2-hydroxystearic acid amide, stearic amide, phthalic anhydride imide, and chlorinated hydrocarbons; and a crystalline polymer containing a long-chain alkyl group at a side chain of the polymer such as a homopolymer of polymethacrylic acid n-stearyl or polymethacrylic acid n-lauryl, which are a crystalline polymer having low molecular weight, and a copolymer (e.g., acrylic acid n-stearyl-methacrylic acid ethyl copolymer).

Among them, Fischer-Tropsch wax, paraffin wax, microcrystalline wax, monoester wax, and rice wax are preferable because an amount of an unnecessary volatile organic compounds generated during fixing is low.

As the release agent, a commercially available product can be used. Examples of the microcrystalline wax include: "HI-MIC-1045", "HI-MIC-1070", "HI-MIC-1080", and "HI-MIC-1090" (all products of NIPPON SEIRO CO., LTD.); "BE SQUARE 180 WHITE" and "BE SQUARE 195" (all products of TOYO ADL CORPORATION); "BARECO C-1035" (product of WAX Petrolife); and "CRAYVALLAC WN-1442" (product of Cray Vally).

A melting point of the release agent is not particularly limited and may be appropriately selected depending on the intended purpose, but it is preferably a range of from 60° C. through 100° C., more preferably a range of from 65° C. through 90° C. When the melting point of the release agent is 60° C. or more, the release agent can be prevented from being oozed from the toner particles, and the resultant toner can be excellent in retaining heat resistant storage stability, even if the toner is stored at a high temperature of 30° C. to 50° C. When the melting point of the release agent is 100° C. or less, it is preferable that the toner can be prevented from causing cold offset during fixing at low temperature.

The melting point is measured by DSC. For example, TA-60WS and DSC-60 (all products of SHIMADZU CORPORATION) can be used to measure the melting point based on the following measurement conditions.

(Measurement Conditions)

Sample container: aluminum sample pan (including lid)

Amount of sample: 5 mg

Reference: aluminum sample pan (alumina 10 mg)

Atmosphere: nitrogen (flow rate 50 mL/min)

Temperature Conditions

1st. heating: starting temperature: 20° C., heating rate: 10° C./min, end temperature: 150° C., retention time: nothing 1st. cooling: cooling rate: 10° C./min, end temperature: 20° C., retention time: nothing 2nd. heating: heating rate: 10° C./min, end temperature: 150° C.

A data analyzing software (TA-60, VERSION 1.52, product of SHIMADZU CORPORATION) is used to analyze the measurement results.

A temperature of a peak top of an endothermic peak measured in 2nd heating is used as the melting point.

The release agent is preferably present in a state of dispersing the release agent in the toner base particles. Therefore, the release agent is preferably incompatible with the binder resin. A method for finely dispersing the release agent in the toner base particles is not particularly limited and may be appropriately selected depending on the intended purpose. Examples of the method include a method for dispersing the release agent through shearing force during kneading the materials for producing the toner.

A state of dispersing the release agent can be confirmed by observing thin film slices of the toner particles by a transmission electron microscope (TEM). A diameter of the release agent dispersed is preferably small. However, the diameter of the release agent dispersed is too small, and thus the release agent may not be sufficiently oozed during fixing. Therefore, in cases where the release agent can be confirmed at '10,000 magnification, the release agent exists in a state of being dispersed. In cases where the release agent cannot be confirmed at '10,000 magnification, the release agent cannot be sufficiently oozed during fixing, even if it is finely dispersed.

An amount of the release agent in the toner is not particularly limited and may be appropriately selected depending on the intended purpose, but it is preferably a range of from 3% by mass through 15% by mass, more preferably a range of from 5% by mass through 10% by mass. When the amount of the release agent in the toner is less than 3% by mass, it is not preferable that the resultant toner may be deteriorated in hot offset resistance. When the amount of the release agent in the toner is more than 15% by mass, it is not preferable that an amount of the release agent oozed from the toner may be excessive, and thus the resultant toner be deteriorated in heat resistant storage stability.

<<Other Components>>

—Colorant—

A colorant used for the toner is not particularly limited and may be appropriately selected from known colorants depending on the intended purpose.

The color of the colorant used for the toner is not particularly limited and may be appropriately selected depending on the intended purpose, but it can be at least one selected from the group consisting of black toner, cyan toner, magenta toner, and yellow toner. The toner for each color can be obtained by appropriately selecting various colorants, but is preferably color toner.

Examples of a colorant for black include: carbon blacks (C.I. Pigment Black 7) such as Furnace black, Lamp black, Acetylene black, and Channel black; metals such as copper, iron (C.I. Pigment Black 11), and titanium oxide; and organic pigments such as aniline black (C.I. Pigment Black 1).

Examples of a pigment for magenta includes: C.I. Pigment Red series (1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, and 269); Pigment Violet 19; and C.I. Vat Red series (1, 2, 10, 13, 15, 23, 29, and 35).

Examples of a pigment for cyan include: C.I. Pigment Blue series (2, 3, 15, 15:1, 15:2, 15:3, 15:4, 15:6, 16, 17, and 60); C.I. Vat Blue 6; C.I. Acid Blue 45; copper phthalocyanine pigment having a phthalocyanine skeleton and 1 to 5 phthalimidomethyl groups substituted thereto; Green 7; and Green 36.

Examples of a pigment for yellow include: C.I. Pigment Yellow series (1, 2, 3, 4, 5, 6, 7, 10, 11, 12, 13, 14, 15, 16, 17, 23, 55, 65, 73, 74, 83, 97, 110, 139, 151, 154, 155, 180, and 185); C.I. Vat Yellow series (1, 3, and 20); and Orange 36.

An amount of the colorant in the toner is preferably a range of from 1% by mass through 15% by mass, more preferably a range of from 3% by mass through 10% by mass. When the amount of the colorant in the toner is less than 1% by mass, the resultant toner may be deteriorated in coloring power. When the amount of the colorant in the toner is more than 15% by mass, the pigment is not sufficiently dispersed in the toner, and thus the resultant toner may be deteriorated in coloring power and electrical property.

The colorant may be used in the form of a master batch in which it is combined with a resin. The resin is not particularly limited, but a binder resin or a resin having the similar structure to the structure of the binder resin is preferable in terms of compatibility of the binder resin.

The master batch can be produced by mixing or kneading the resin and the colorant through high shearing force. In the mixing and kneading, an organic solvent may be added to the colorant and the resin in order to improve the interactions between the colorant and the resin. Moreover, the so-called flashing method is preferable because a wet cake can be used as it is, and is not necessary to dry. The flashing method is a method for removing water or an organic solvent by mixing or kneading an aqueous paste containing water of the colorant with the resin and the organic solvent, to transfer the colorant to the resin side. In the mixing and kneading, a high-shearing disperser such as a three-roll mill can be preferably used.

—Charge Controlling Agent—

In order to impair appropriate charging ability to a toner, the toner can contain a charge controlling agent if necessary.

As the charge controlling agent, any of known charge controlling agents can be used. Use of the charge controlling agent containing colored materials may change a color tone of the toner, and thus the charge controlling agent preferably contains colorless materials or materials close to white. Examples of the charge controlling agent include triphenylmethane dyes, molybdic acid chelate pigments, rhodamine dyes, alkoxy amines, quaternary ammonium salts (including fluorine-modified quaternary ammonium salts), alkylamides, phosphorus or phosphorus compounds, tungsten or tungsten compounds, fluorine active agents, metal salts of salicylic acid, and metal salts of salicylic acid derivatives. These may be used alone or in combination thereof.

An amount of the charge controlling agent is determined depending on a method for producing the toner, the method containing the kind of the binder resin and a method for dispersing the binder resin, and is not unambiguously limited. The amount of the charge controlling agent added is preferably a range of from 0.01% by mass through 5% by mass, more preferably a range of from 0.02% by mass through 2% by mass, relative to an amount of the binder resin. The amount of the charge controlling agent of more than 5% by mass may cause considerably high charging ability of the toner, reduction of an effect of the charge controlling agent, and high electrostatic attractive force to a developing roller, which may result in reduction of flowability of the developer and reduction of image density. The amount of the charge controlling agent of less than 0.01% by mass may cause insufficiency of charge rising and an amount of charge, which may influence a toner image.

<<External Additive>>

The external additive is not particularly limited and may be appropriately selected from known external additives. Examples of the external additive include: silica fine particles, hydrophobic silica fine particles, fatty acid metal salts (e.g., zinc stearate and aluminum stearate); metal oxides (e.g., titania, alumina, tin oxide, and antimony oxide) or a hydrophobic product thereof, and fluoropolymer. Among them, hydrophobic silica fine particles, titania fine particles, and hydrophobic titania fine particles are preferable.

Examples of the hydrophobic silica fine particles include: HDK H 2000T, HDK H 2000/4, HDK H 2050EP, HVK 21, and HDK H 1303VP (all products of Clamant (Japan) K.K.); and R972, R974, RX200, RY200, R202, R805, R812, and NX90G (all products of Nippon Aerosil Co., Ltd.).

Examples of the titania fine particles include: P-25 (product of Nippon Aerosil Co., Ltd.); STT-30 and STT-65C-S (both products of Titan Kogyo, Ltd.); TAF-140 (product of Fuji Titanium Industry Co., Ltd.); and MT-150 W, MT-500B, MT-600B, and MT-150A (all products of TAYCA CORPORATION).

Examples of the hydrophobic titanium oxide fine particles include: T-805 (product of Nippon Aerosil Co., Ltd.); STT-30A and STT-65S-S(both products of Titan Kogyo, Ltd.); TAF-500T and TAF-1500T (both products of Fuji Titanium Industry Co., Ltd.); T-100S and MT-100T (both products of TAYCA CORPORATION); and ITS (product of ISHIHARA SANGYO KAISHA, LTD.).

An amount of the external additive is not particularly limited and may be appropriately selected depending on the intended purpose, but it is preferably a range of from 0.3 parts by mass through 3.0 parts by mass, more preferably a range of from 0.5 parts by mass through 2.0 parts by mass, relative to 100 parts by mass of the toner base particles.

A total coverage ratio of the external additive on the toner base particle is not particularly limited, but it is preferably a range of from 50% through 90%, more preferably a range of from 60% through 80%.

<Method for Producing Toner>

As a method for producing a toner of the present invention and materials of the toner, all known methods and materials can be used without any limitation so long as these methods and materials satisfy the conditions. Examples of the methods include a kneading-pulverization method, and a chemical method in which toner particles are granulated in an aqueous medium.

Examples of the chemical methods include a suspension polymerization method, an emulsion polymerization method, a seed polymerization method, a dispersion polymerization method; a dissolution suspension method; an ester elongation method; an inverse emulsification method; and an aggregation method. Here, the suspension polymerization method, the emulsion polymerization method, the seed polymerization method, the dispersion polymerization method are methods for producing the toner using a monomer as a starting material. The dissolution suspension method is a method for producing the toner by dissolving a resin or a resin precursor in an organic solvent, to disperse or emulsify the resultant solution in an aqueous medium. The ester elongation method includes part of the dissolution suspension method, and is a method for producing the toner by dispersing or emulsifying an oil composition in a resin fine particles-containing aqueous medium, to react an active hydrogen group-containing compound with reactive group-containing prepolymer in the aqueous medium, where the oil composition contains a resin precursor (reactive group-containing prepolymer) containing a functional group that can react with an active hydrogen group. The inverse emulsification method is a method for inverting a phase by adding water to a solution containing an appropriate emulsifying agent and a resin or a resin precursor. The aggregation method is a method in which resin particles obtained by these methods are aggregated in a state of being dispersed in an aqueous medium, to granulate particles having a desired size by heating and melting. Among them, a toner obtained by the dissolution suspension method, the ester elongation method, or the aggregation method is preferable, a toner obtained by the ester elongation method is more preferable, in terms of granulating property (e.g., controlling particle size distribution and controlling particle shape).

These methods will be described in detail hereinafter.

The kneading and pulverizing method is a method for producing toner base particles by pulverizing and classifying the melt-kneaded toner materials containing at least a colorant, a binder resin, and a release agent.

In the melt-kneading, the toner materials are mixed, and the resultant mixture is charged into a melt-kneader, followed by melt-kneading the resultant mixture. Examples of the melt-kneader include a single-screw or twin-screw continuous kneader, or a batch-type kneader with a roll mill. For example, a KTT type twin screw extruder (product of KOBE STEEL, Co.), a TEM type extruder (product of TOSHIBA MACHINE Co.), a twin screw extruder (product of KCK Engineering Co.), a PCM type twin screw extruder (product of Ikegai Co.), and a co-kneader (product of Buss Co.) are preferably used. The melt-kneading is preferably performed under such appropriate conditions that will not cause the cutting of the molecular chain in the binder resin. Specifically, a melt-kneading temperature is set considering a softening point of the binder resin. The melt-kneading temperature is higher than the softening point of the binder resin, which may result in severe cutting of the molecular chain. The melt-kneading temperature is too low, which may not proceed to dispersion.

In the pulverizing, the kneaded product obtained in the kneading is pulverized. In this pulverizing, it is preferable that the kneaded product be coarsely pulverized, followed by finely pulverizing the coarsely pulverized product. At this time, a method in which the kneaded product is pulverized by making the kneaded product to crush into an impact plate in the jet stream, a method in which the kneaded product is pulverized by making particles of the kneaded product to crush with each other in the jet stream, and a method in which the kneaded product is pulverized in a narrow gap between a mechanically rotating rotor and a stator are preferably used.

In the classifying, pulverized products obtained in the pulverizing are classified to adjust them to particles having a predetermined particle diameter. The classifying is performed by removing part of fine particles using a cyclone, a decanter, or a centrifugal separator.

After finishing the pulverizing and the classifying, the pulverized products can be classified through centrifugal force under a stream, to produce toner base particles having a predetermined particle diameter.

The dissolution suspension method is a method for producing toner base particles obtained by dispersing or emulsifying an oil phase composition in an aqueous medium, where the oil phase composition is obtained by dispersing or emulsifying, in an organic solvent, a toner composition containing at least binder resin or a resin precursor, a colorant, and a release agent.

As an organic solvent used for dissolving or dispersing the toner composition, a volatile organic solvent having a boiling point of less than 100° C. is preferably used because the subsequent operation of removing the solvent is easy to perform.

Examples of the organic solvent include: an ester solvent or an ester ether solvent such as ethyl acetate, butyl acetate, methoxybutyl acetate, methyl cellosolve acetate, and ethyl cellosolve acetate; an ether solvent such as diethyl ether, tetrahydrofuran, dioxane, ethyl cellosolve, butyl cellosolve, and propylene glycol monomethyl ether; a ketone solvent such as acetone, methyl ethyl ketone, methyl isobutyl ketone, di-n-butyl ketone, and cyclohexanone; an alcohol solvent such as methanol, ethanol, n-propanol, isopropanol, n-butanol, isobutanol, t-butanol, 2-ethylhexylalcohol, and benzyl alcohol; and a mixture solvent obtained in combination with two or more of the aforementioned solvents.

In the dissolution suspension method, an emulsifying agent or a dispersing agent may be used if necessary in order to disperse or emulsify an oil phase composition in an aqueous medium.

As the emulsifying agent or the dispersing agent, known surfactants and known water-soluble polymers can be used.

The surfactant is not particularly limited. Examples of the surfactant include an anionic surfactant (e.g., alkyl benzene sulfonic acid and phosphoric acid ester), a cationic surfactant (e.g., quaternary ammonium salt type and amine salt type), an amphoteric surfactant (e.g., carboxylic acid salt type, sulfuric acid ester salt type, sulfonic acid salt type, and phosphoric acid ester salt type), and a nonionic surfactant (e.g., AO-added type and polyvalent alcohol type). These surfactants may be used alone or in combination thereof.

Examples of the water-soluble polymer include a cellulose compound (e.g., methyl cellulose, ethyl cellulose, hydroxyethyl cellulose, ethylhydroxyethyl cellulose, carboxy methyl cellulose, hydroxypropyl cellulose, and a saponified compound thereof), gelatin, starch, dextrin, Gum arabic, chitin, chitosan, polyvinyl alcohol, polyvinyl pyrrolidone, polyethylene glycol, polyethylene imine, polyacrylamide, an acrylic acid (salt)-containing polymer (e.g., polyacrylic acid sodium, polyacrylic acid potassium, polyacrylic acid ammonium, a product obtained by neutralizing a sodium hydroxide part of polyacrylic acid, and acrylic acid sodium-acrylic acid ester copolymer), a product obtained by neutralizing a sodium hydroxide part of styrene-maleic anhydride copolymer, and a water soluble polyurethane (e.g., a product obtained by reacting polyisocyanate with polyethylene glycol or polycaprolactone diol).

Moreover, the organic solvent and a plasticizer can be used together as an auxiliary agent for emulsification or dispersion.

A toner of the present invention is preferably obtained by a method (ester elongation method) described as follows: in the dissolution suspension method, an oil phase composition is dispersed or emulsified in a resin fine particles-containing aqueous medium, and the reactive group-containing prepolymer is reacted with the at least one selected from the group consisting of the oil phase composition and an active hydrogen group-containing compound in an aqueous medium to granulate toner base particles, where the oil phase composition contains a binder resin, a binder resin precursor containing a group reactive to an active hydrogen group (reactive group-containing prepolymer), a colorant, and a release agent.

The resin fine particles can be formed by known polymerization method, but are preferably obtained by preparing an aqueous dispersion liquid of resin fine particles. As a method for preparing the aqueous dispersion liquid of resin fine particles, methods (a) to (h) can be used as described below.

(a) A method in which a vinyl monomer as a starting material is polymerized by the suspension polymerization method, the emulsification polymerization method, the seed polymerization method, or the dispersion polymerization method, to thereby directly prepare an aqueous dispersion liquid of resin fine particles.

(b) A method in which a precursor (e.g., a monomer or an oligomer) of a polyaddition resin or a condensation resin (e.g., a polyester resin, a polyurethane resin, or an epoxy resin) or a solvent solution thereof is dispersed in an aqueous medium in the presence of an appropriate dispersant, and then the resultant solution is cured by heating or by the addition of a curing agent, to thereby prepare an aqueous dispersion liquid of resin fine particles.

(c) A method in which an emulsifier is dissolved in a precursor (e.g., a monomer or an oligomer) of a polyaddition resin or a condensation resin (e.g., a polyester resin, a polyurethane resin, or an epoxy resin) or a solvent solution thereof (which is preferably liquid, or may be changed to liquid with heat), and is phase-inverted by the addition of water, to thereby prepare an aqueous dispersion liquid of resin fine particles.

(d) A method in which a resin that has previously been synthesized through polymerization reaction (e.g., addition polymerization, ring-opening polymerization, polyaddition, addition condensation, or condensation polymerization) is pulverized with a pulverizing mill, for example, mechanical rotation-type or jet-type, and is classified for obtaining resin fine particles, which are then dispersed in water in the presence of an appropriate dispersant, to thereby prepare an aqueous dispersion liquid of resin fine particles.

(e) A method in which a resin that has previously been synthesized through polymerization reaction (e.g., addition polymerization, ring-opening polymerization, polyaddition, addition condensation, or condensation polymerization) is dissolved in a solvent to prepare a resin solution, the resin solution is sprayed in the form of mist for obtaining resin fine particles, which are then dispersed in water in the presence of an appropriate dispersant, to prepare an aqueous dispersion liquid of resin fine particles.

(f) A method in which a resin that has previously been synthesized through polymerization reaction (e.g., addition polymerization, ring-opening polymerization, polyaddition, addition condensation, or condensation polymerization) is dissolved in a solvent to prepare a resin solution, and then a poor solvent is added to the resin solution, or the resin solution previously dissolved in a solvent is cooled, to precipitate resin fine particles, the solvent is removed for forming resin fine particles, which are then dispersed in water in the presence of a suitable dispersant, to thereby prepare an aqueous dispersion liquid of resin fine particles.

(g) A method in which a resin that has previously been synthesized through polymerization (e.g., addition polymerization, ring-opening polymerization, polyaddition, addition condensation, or condensation polymerization) is dissolved in a solvent to prepare a resin solution, the resin solution is dispersed in an aqueous medium in the presence of a suitable dispersant, and the solvent is removed by heating or under reduced pressure, to prepare an aqueous dispersion liquid of resin fine particles.

(h) A method in which a resin that has previously been synthesized through polymerization (e.g., addition polymerization, ring-opening polymerization, polyaddition, addition condensation, or condensation polymerization) is dissolved in a solvent to prepare a resin solution, an appropriate emulsifying agent is dissolved in the resin solution, the resultant solution undergoes phase-transfer emulsification by adding water thereto, to prepare an aqueous dispersion liquid of resin fine particles.

A volume average particle diameter of the resin fine particles is preferably a range of from 10 nm through 300 nm, more preferably a range of from 30 nm through 120 nm. When the volume average particle diameter of the resin fine particles is less than 10 nm or more than 300 nm, it is not preferable that the particle size distribution of the toner may be deteriorated.

A solid content concentration of the oil phase is preferably a range of from about 40% through about 80%. When the solid content concentration of the oil phase is too high, the toner materials are difficult to dissolve or disperse, a viscosity of the toner is high, and thus the resultant toner has difficulty in use. When the solid content concentration of the oil phase is too low, productivity of the toner is deteriorated.

A toner composition other than the binder resin such as the colorant and the release agent, and a master batch of the above materials are each individually dissolved or dispersed in an organic solvent, to be mixed with a binder resin dissolving solution or a binder resin dispersing solution.

As the aqueous medium, water can be used alone, or a solvent capable of being mixed with water can be used in combination with the water. Examples of the solvent capable of being mixed with water include alcohols (e.g., methanol, isopropanol, and ethylene glycol), dimethyl formamide, tetrahydrofuran, cellosolves (e.g., methyl cellosolve), and lower ketones (e.g., acetone and methyl ethyl ketone).

A method for dispersing or emulsifying the oil phase in the aqueous medium is not particularly limited. Examples of the method for dispersing or emulsifying the oil phase in the aqueous medium include known equipment such as a low-speed shearing disperser, a high-speed shearing disperser, a friction disperser, a high-pressure jetting disperser, and an ultrasonic disperser. Among them, a high-speed shearing disperser is preferable in terms of making the particle size smaller. When a high-speed shearing disperser is used, a rotating speed of the high-speed shearing disperser is not particularly limited, but it is preferably a range of from 1,000 rpm through 30,000 rpm, more preferably a range of from 5,000 rpm through 20,000 rpm. A temperature at which the dispersion is performed using the high-speed shearing disperser is generally a range of from 0° C. through 150° C. (under pressurization), preferably a range of from 20° C. through 80° C.

A method for removing the organic solvent from the obtained emulsified dispersion is not particularly limited and known methods for removing the organic solvent can be used. A method in which the temperature is gradually increased under normal pressure or reduced pressure with stirring, to evaporate and remove the organic solvent in droplets can be employed.

As a method for washing and drying toner base particles dispersed in an aqueous medium, known techniques can be used. That is, solid-liquid separation is performed by a centrifugal separator or a filter press, the thus-obtained toner cake is re-dispersed in a deionized-water of normal temperature to about 40° C., and then a pH of the dispersed material is adjusted with an acid or an alkaline if necessary. Then, a step of the solid-liquid separation is repeated several times to remove impurity products or the surfactant. Then, the thus-obtained product is dried with a flash dryer, a circulation dryer, a vacuum dryer, and a vibration flash dryer, to obtain toner powders. At this time, a component of toner fine particles may be removed through centrifugation. A desired particle size distribution can be obtained using a known classifying device after drying, if necessary.

The aggregation method is a method for producing toner base particles by mixing a resin fine particles dispersion liquid containing a binder resin, a colorant particles dispersion liquid, and a release agent particles dispersion liquid (if necessary) for aggregation. The resin fine particles dispersion liquid can be obtained through known methods such as the emulsification polymerization, the seed polymerization, and the phase-inversion. The colorant particles dispersion liquid and the release agent particles dispersion liquid can be obtained by dispersing a colorant or a release agent in an aqueous medium by a known wet dispersion method.

In order to control the aggregated state, it is preferable that heat be applied thereto, that a metal salt be added thereto, and that a pH of the toner be adjusted.

A metal forming the metal salt is not particularly limited. Examples of the metal forming the metal salt include a monovalent metal forming sodium salts and potassium salts; a divalent metal forming calcium salts and magnesium salts; and a trivalent metal forming aluminum salts.

Examples of an anion forming the metal salt include a chloride ion, a buromide ion, an iodide ion, a carbonate ion, and a sulfate ion. Among them, magnesium chloride, aluminum chloride, a complex thereof, and a multimer thereof are preferable.

The heating is preferably performed in the course of the aggregation or after the aggregation, which can promote fusion between the resin fine particles in terms of uniformity of the resultant base particles. Moreover, it is possible to control the shape of the toner by the heating. The base particles become closer to a spherical shape by further applying heat thereto.

A method for washing and drying the toner base particles dispersed in the aqueous medium can be performed by the aforementioned methods.

In order to improve flowability, storage stability, developability, and transferability of the toner, the above coalesced particles are added to the toner base particles produced as described above and are mixed, but inorganic fine particles such as hydrophobic silica fine powders may be added to the toner base particles and are mixed.

A general powders mixer is used to mix an additive agent, and is preferably adjustable in its inner temperature by a jacket or the like provided to the mixer. Note that, the additive agent may be added gradually or in the course of the mixing, in order to change the history of the load applied to the external additive. In this case, the number of rotations, a rotation speed, a mixing time, and a temperature of the mixer may be changed. Also, a large load may be initially applied to the additive agent, and next a relatively small load may be applied thereto, or vice versa.

As a mixing equipment, a V-type Mixer, a Rocking Mixer, a Lodige Mixer, a Nauta Mixer, and a Henschel Mixer can be used. Next, the resultant mixture may be passed through a sieve of 250 mesh or more, and thus coarse particles and aggregation particles are removed, to obtain the toner.

(Developer)

A developer of the present invention contains at least the toner, further contains other components appropriately selected such as a carrier. The developer may be a one-component developer or a two-component developer. However, the two-component developer is preferably used for recent high-speed printers responding to improved information processing speed, in terms of improvement of lifetime of the printer.

When the toner is used for the one-component developer, the toner particles is prevented from aggregation due to stress applied from the developing unit over time, filming on the developing roller, and fusion on a layer-thickness regulating member such as a blade configured to thin a toner layer. Therefore, stability of image density and transfer property are favorably maintained, and thus an image having good and stable quality can be obtained. When the toner is used for the two-component developer, aggregation of the toner particles due to stress applied from the developing unit does not easily occur over time, so that formation of an abnormal image is suppressed, and thus stability of image density and transfer property can be favorably maintained, which leads to excellent and stable image quality.

<Carrier>

The carrier is not particularly limited and may be appropriately selected depending on the intended purpose, but it preferably contains core particles and a resin layer (coating layer) coating the core particles.

<<Core Particles>>

The core particles are not particularly limited and may be appropriately selected depending on the intended purpose, so long as it has magnetism. Examples of the core particles include resin particles obtained by dispersing a magnetic material such as a ferromagnetic metal (e.g., iron and cobalt); and iron oxide (e.g., magnetite, hematite, and ferrite) in a resin. Among them, Mn ferrite, Mn—Mg ferrite, and Mn—Mg—Sr ferrite are preferable because they are environmental friendly.

—Weight Average Particle Diameter (Dw) of Core Particles—

A weight average particle diameter (Dw) of the core particles is a particle diameter at an integrated value of 50% in the particle size distribution obtained by a laser diffraction scattering method. A weight average particle diameter (Dw) of the core particles is not particularly limited and may be appropriately selected depending on the intended purpose, it is preferably a range of from 10 μm through 80 μm, more preferably a range of from 20 μm through 65 μm.

A weight average particle diameter (Dw) of the core particles can be calculated from the following Formula (I) based on the particle size distribution of the particles (relation between number frequency and particle diameter) measured on a number basis with micro track particle size analyzer HRA9320-X100 (product of Honewell Co.). Here, each channel is a length for dividing the range of the particle diameters in the particle size distribution diagram into a unit width for measurement. A lower limit value of particle diameter stored in each channel is used as a representative particle diameter.

$$Dw=\{1/\Sigma(nD_3)\}^{1}\{\Sigma(nD_4)\} \quad (I)$$

where, in the Formula (I), D represents a representative particle diameter (m) of core particles present in each channel, and n represents the total number of core particles present in each channel.

(Measurement Conditions)

[1] Particle diameter range: 8 μm to 100 μm

[2] Channel length (channel width): 2 μm

[3] Number of channels: 46

[4] Refraction index: 2.42

<<Coating Layer>>

The coating layer preferably contains at least a resin, further contains other components such as a filler.

—Resin—

A resin used for forming a coating layer of a carrier is not particularly limited and may be appropriately selected depending on the intended purpose. Examples of the resin include: a crosslinkable copolymer product including, for example, polyolefin (e.g., polyethylene and polypropylene) or a modified product thereof, a polystyrene•acryl resin, acrylonitrile, vinyl acetate, vinyl alcohol, vinyl chloride, vinyl carbazole, and vinyl ether; a silicone resin containing an organosiloxane bond or a modified product thereof (e.g., a modified product of an alkyd resin, a polyester resin, an epoxy resin, polyurethane, and polyimide); polyamide; polyester; polyurethane; polycarbonate; a urea resin; a melamine resin; a benzoguanamine resin; an epoxy resin; an ionomer resin; a polyimide resin; and a derivative thereof. These may be used alone or in combination thereof. Among them, a silicone resin is preferable.

The silicone resin is not particularly limited and may be appropriately selected from the generally-known silicone resins depending on the intended purpose. Examples of the silicone resin a straight silicone resin containing only an organosiloxane bond, and a silicone resin modified with alkyd, polyester, epoxy, acryl, and urethane.

Examples of the straight silicone resin include: KR271, KR272, KR282, KR252, KR255, and KR152 (all products of Shin-Etsu Chemical Co., Ltd.); and SR2400, SR2405, SR2406 (all products of Dow Corning Toray Co., Ltd.).

Specific examples of the above modified silicone resin include an epoxy-modified product (ES-1001N), an acryl-modified silicone (KR-5208), a polyester-modified product (KR-5203), an alkyd-modified product (KR-206), a urethane-modified product (KR-305) (all products of Shin-Etsu Chemical Co., Ltd.), and an epoxy-modified product (SR2115) and an alkyd-modified product (SR2110) (all products of Dow Corning Toray Co., Ltd.).

Note that, the silicone resin can be used alone, but can be used in combination of a crosslinkage reactive component and a charge amount adjusting component.

Examples of the crosslinkage reactive component include a silane coupling agent. Examples of the silane coupling agent include methyl trimethoxysilane, methyl triethoxysilane, octyltrimethoxysilane, and an aminosilane coupling agent.

—Filler—

The filler is not particularly limited and may be appropriately selected depending on the intended purpose. Examples of the filler include an electroconductive filler and a non-electroconductive filler. These may be used alone or in combination thereof. Among them, the filler preferably contains the coating layer containing the electroconductive filler and the non-electroconductive filler.

The electroconductive filler means a filler having a powder electric specific resistance value of 100 Ω·cm or less.

The non-electroconductive filler means a filler having a powder electric specific resistance value of more than 100 Ω·cm.

Measurement of a powder electric specific resistance value of the filler can be performed using a powder resistance measurement system (MCP-PD51, product of Daia Instruments) and a resistivity meter (4-terminal and 4-probe type, Loresta-GP, product of Mitsubishi Chemical Analytech Co.) under the following conditions: sample; 1.0 g, electrode interval; 3 mm, radius of sample; 10.0 mm, load; 20 kN.

—Electroconductive Filler—

The electroconductive filler is not particularly limited and may be appropriately selected depending on the intended purpose. Examples of the electroconductive filler include: an electroconductive filler in which a layer of tin dioxide or indium oxide is formed on a base such as aluminum oxide, titanium oxide, zinc oxide, barium sulfate, and silicon oxide;

and an electroconductive filler formed by using carbon black. Among them, an electroconductive filler containing aluminum oxide, titanium oxide, or barium sulfate is preferable.

—Non-Electroconductive Filler—

The non-electroconductive filler is not particularly limited and may be appropriately selected depending on the intended purpose. Examples of the non-electroconductive filler include a non-electroconductive filler made using, for example, aluminum oxide, titanium oxide, barium sulfate, zinc oxide, silicon dioxide, or zirconium oxide. Among them, a non-electroconductive filler containing aluminum oxide, titanium oxide, or barium sulfate is preferable.

<Method for Producing Carrier>

A method for producing the carrier is not particularly limited and may be appropriately selected depending on the intended purpose. A method in which the surface of the core particle is coated with a coating layer forming solution containing the resin to form a carrier is preferable. Note that, when the surface of the core particle is coated with the coating layer forming solution, the resin contained in the coating layer may undergo condensation. Alternatively, after the surface of the core particle is coated with the coating layer forming solution, the resin contained in the coating layer may undergo condensation.

A method for condensing the resin is not particularly limited and may be appropriately selected depending on the intended purpose. Examples of the method for condensing the resin include a method for condensing the resin by applying heat or light to the coating layer forming solution.

—Weight Average Particle Diameter (Dw) of Carrier—

A weight average particle diameter (Dw) of the carrier is a particle diameter of the core particles at an integrated value of 50% in the particle size distribution obtained by a laser diffraction scattering method. A weight average particle diameter (Dw) of the carrier is not particularly limited and may be appropriately selected depending on the intended purpose, it is preferably a range of from 10 μm through 80 μm, more preferably a range of from 20 μm through 65 μm.

A weight average particle diameter (Dw) of the carrier can be calculated from the following Formula (II) based on the particle size distribution of the particles (relation between number frequency and particle diameter) measured on a number basis with micro track particle size analyzer HRA9320-X100 (product of Honewell Co.). Here, each channel is a length for dividing the range of the particle diameters in the particle size distribution diagram into a unit width for measurement. A lower limit value of particle diameter stored in each channel is used as a representative particle diameter.

$$Dw=\{1/\Sigma(nD3)\}'\{\Sigma(nD4)\} \quad \text{(II)}$$

where, in the Formula (II), D represents a representative particle diameter (μm) of a carrier present in each channel, and n represents the total number of particles present in each channel.

(Measurement Conditions)

[1] Particle diameter range: 8 μm to 100 μm

[2] Channel length (channel width): 2 μm

[3] Number of channels: 46

[4] Refraction index: 2.42

When the developer is a two-component developer, a ratio of the toner to the carrier in the two-component developer is 2.0% by mass to 12.0% by mass, more preferably a range of from 2.5% by mass through 10.0% by mass, relative to an amount of the carrier.

(Toner Stored Unit)

A toner stored unit of the present invention stores a toner in a unit having a function of storing the toner. Here, aspects of the toner stored unit are, for example, a toner stored container, a developing device, and a process cartridge.

The toner stored container is a container storing a toner.

The developing device includes a unit storing a toner, and configured to perform development.

The process cartridge integrally includes an image bearer and a developing unit, stores a toner, and is detachable to an image forming apparatus. The process cartridge may further include at least one selected from the group consisting of a charging unit, an exposing unit, and a cleaning unit.

A toner stored unit of the present invention is mounted on an image forming apparatus to form an image, and thus a toner of the present invention is used to form an image, which can lead to excellence in low temperature fixing ability, heat resistant storage stability, and charging stability.

(Image Forming Method and Image Forming Apparatus)

An image forming method used in the present invention includes: an electrostatic latent image forming step, a developing step, a transfer step, and a fixing step; and further includes: other steps appropriately selected depending on the intended purpose, such as a charge-eliminating step, a cleaning step, a recycling step, and a controlling step. Here, the electrostatic latent image forming step is a step of forming an electrostatic latent image on an electrostatic latent image bearer, and the developing step is a step of developing the electrostatic latent image using the toner of the present invention to form a visible image, and the transfer step is a step of transferring the visible image to form a transferred image on a recording medium, and the fixing step is a step of fixing the transferred image on the recording medium.

An image forming apparatus of the present invention includes: an electrostatic latent image bearer; an electrostatic latent image forming unit configured to form an electrostatic latent image on the electrostatic latent image bearer; a developing unit configured to develop the electrostatic latent images with the toner of the present invention to form a visible image; a transfer unit configured to transfer the visible image to form a transferred image on a recording medium; and a fixing unit configured to fix the transferred image on the recording medium. The image forming apparatus of the present invention further includes other units appropriately selected depending on the intended purpose, such as a charge-eliminating unit, a cleaning unit, a recycling unit, and a controlling unit. Details will be described hereinafter.

—Electrostatic Latent Image Forming Step and Electrostatic Latent Image Forming Unit—

The electrostatic latent image forming step is a step of forming an electrostatic latent image on an electrostatic latent image bearer.

A material, a shape, a structure, and a size of the electrostatic latent image bearer (may be referred to as "electrophotographic photoconductor" and "photoconductor") are not particularly limited and may be appropriately selected from known electrostatic latent image bearers. Examples of the shape of the electrostatic latent image bearer include a drum-shaped electrostatic latent image bearer. Examples of the material of the electrostatic latent image bearer include an inorganic photoconductor (e.g., amorphous silicon and selenium), and an organic photoconductor (OPC) (e.g., polysilane and phthalopolymethine). Among them, an organic photoconductor (OPC) is preferable because an image with higher fineness can be obtained.

The electrostatic latent image can formed by an electrostatic latent image forming unit, where the electrostatic latent image forming unit uniformly charges the surface of the electrostatic latent image bearer, followed by imagewise exposing.

The electrostatic latent image forming unit includes: at least a charging unit (charging device) configured to uniformly charge the surface of the electrostatic latent image bearer; and an exposing unit (exposing device) configured to imagewise expose the surface of the electrostatic latent image bearer.

For example, the charging can be performed by applying a voltage to a surface of the electrostatic latent image bearer using the charging device.

The charging device is not particularly limited and may be appropriately selected depending on the intended purpose. Examples of the charging device include known contact charging devices, equipped with an electroconductive or semiconductive roller, brush, film, or rubber blade, and a non-contact charging device utilizing corona discharge, such as corotron and scorotron.

It is preferred that the charging device be provided in contact with the electrostatic latent image bearer, or in non-contact with the electrostatic latent image bearer, and the surface of the electrostatic latent image bearer be charged by applying superimposed AC voltage and DC voltage.

Moreover, it is preferred that the charging device be charging roller disposed adjacent to the electrostatic latent image bearer in a non-contact manner via a gap tape, and configured to charge the surface of the electrostatic latent image bearer by applying superimposed AC voltage and DC voltage to the charging roller.

The exposure can be performed by imagewise exposing the surface of the electrostatic latent image bearer using the exposing device.

The exposing device is not particularly limited and may be appropriately selected depending on the intended purpose, so long as it can imagewise expose the surface of the electrostatic latent image bearer charged by the charging device. Examples of the exposing device include various exposure devices, such as a copy optical system, a rod lens array system, a laser optical system, and a crystal shutter optical system. Note that, in the present invention, a back side system may be employed, where the back side system means that imagewise exposure is performed from the back side of the electrostatic latent image bearer.

—Developing Step and Developing Unit—

The developing step is a step of developing the electrostatic latent image using the toner, to form a visible image.

The visible image can be formed by the developing unit, for example, by developing the electrostatic latent image using the toner.

The developing unit suitably contains at least, for example, a developing device that stores the toner, and configured to apply the toner to the electrostatic latent image in a contact or non-contact manner. A developing device including a container with the toner is more preferable.

The developing unit may be a developing unit for a single color, or a developing unit for multicolor. Examples of the developing device include a developing device containing a stirring device configured to stir the toner by friction to be charged and a rotatable magnetic-roller.

In the developing unit, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed near the electrostatic latent image developing member (photoconductor), and thus some of the toner particles that form the magnetic brushes formed on the surface of the magnet roller are transferred onto the surface of the electrostatic latent image developing member (photoconductor) by the action of electrically attractive force. As a result, the electrostatic latent image is developed with the toner particles to form a visible image on the surface of the electrostatic latent image developing member (photoconductor).

—Transfer Step and Transfer Unit—

The transfer step is a step of transferring the visible image onto a recording medium. The transfer step is preferably an aspect where an intermediate transfer member is used to primarily transfer a visible image onto the intermediate transfer member, to secondarily transfer the thus-transferred visible image onto the recording medium. The transfer step is more preferably an aspect including a primary transfer step and a secondary transfer step, where the primary transfer step is a step of transferring a visible image onto an intermediate transfer member using two or more toners, preferably toners of full colors, to form a composite transfer image, and the secondary transfer step is a step of transferring the composite transfer image onto a recording medium.

The transferring can be performed by the transfer unit, for example, by charging the visible image on the electrostatic latent image bearer (photoconductor) using a transfer charger. Examples of the transfer unit include an aspect including a primary transfer unit and a secondary transfer unit, where the primary transfer unit is configured to transfer a visible image onto an intermediate transfer member to form a composite transfer image, and the secondary transfer unit is configured to transfer the composite transfer image on a recording medium.

Note that, the intermediate transfer member is not particularly limited and may be appropriately selected from known transfer members depending on the intended purpose. Examples of the intermediate transfer member suitably include a transfer belt.

The transfer unit (the primary transfer unit and the secondary transfer unit) preferably includes at least a transfer device configured to charge the visible images formed on the electrostatic latent image developing member (photoconductor) onto the recording medium to be transferred onto the recording medium. The number of the transfer unit may be one, or two or more.

Examples of the transfer device include a corona transfer device employing corona discharge, a transfer belt, a transfer roller, a pressing transfer roller, and an adhesive transferring device.

The recording medium is not particularly limited and may be appropriately selected from known recording medium (recording paper).

—Fixing Step and Fixing Unit—

The fixing step is a step of fixing a visible image transferred on recording medium by a fixing device. The fixing step may be performed every time when an image of each color toner is transferred onto the recording medium, or the fixing step may be performed at one time in a state that images of color toners are superposed.

The fixing device is not particularly limited and may be appropriately selected depending on the intended purpose, but it is preferably a known heating-pressurizing unit. Examples of the heating-pressurizing unit include a combination of a heat roller and a press roller, and a combination of a heat roller, a press roller, and an endless belt.

The fixing device includes: a heating member containing a heat generating element; a film configured to contact with the heating member; and a pressurizing member configured to be pressed against the heating member via the film. The fixing device is preferably a unit configured to pass recording medium on which an unfixed image is formed between the film and the pressurizing member, to fix the recording medium with heat. The heating-pressurizing unit usually performs heating preferably at 80° C. to 200° C.

Note that, in the present invention, known photofixing devices may be used instead of or in addition to the fixing step and the fixing unit depending on the intended purpose.

The charge-eliminating step is a step of applying a charge-eliminating bias to the electrostatic latent image bearer, to eliminate charge, and can be performed by a charge-eliminating unit.

The charge-eliminating unit is not particularly limited and may be appropriately selected from known charge-eliminating devices depending on the intended purpose, so long as it apply a charge-eliminating bias to the electrostatic latent image bearer. Examples of the charge-eliminating unit include a charge-eliminating lamp.

The cleaning step is not particularly limited so long as it can remove the toner remaining on the electrostatic latent image bearer, and can be suitably performed by a cleaning unit.

The cleaning step is not particularly limited and may be appropriately selected from known cleaners so long as it can remove the toner reaming on the electrostatic latent image bearer. Examples of the cleaning unit include a magnetic brush cleaner, an electrostatic brush cleaner, a magnetic roller cleaner, a blade cleaner, a brush cleaner, and a web cleaner.

The recycling step is a step of recycling the toner removed by the cleaning step to the developing unit, and can be suitably performed by a recycling unit. The recycling unit is not particularly limited. Examples of the recycling unit include known conveying units.

The controlling step is a step of control each of the above steps, and each of the steps can be suitably performed by a controlling unit.

The controlling unit is not particularly limited and may be appropriately selected depending on the intended purpose, so long as it can control each of the above units. Examples of the controlling unit include devices such as a sequencer and a computer.

FIG. 2 illustrates one example of an image forming apparatus of the present invention. An image forming apparatus 100A includes a photoconductor drum 10, a charging roller 20, an exposing device, a developing device 40, an intermediate transfer belt 50, a cleaning device 60 containing a cleaning blade, and a charge-eliminating lamp 70.

The intermediate transfer belt 50, which is an endless belt, is stretched around three rollers 51 disposed in the belt, and is movable in a direction indicated by the arrow of the figures. A part of three rollers 51 also functions as a transfer bias roller that can apply a transfer bias (primary transfer bias) to the intermediate transfer belt 50. Near the intermediate transfer belt 50, a cleaning device 90 including a cleaning blade is disposed. Also, a transfer roller 80 that can apply a transfer bias (secondary transfer bias) onto a transfer paper 95 configured to transfer a toner image is disposed facing the intermediate transfer belt 50.

Around the intermediate transfer belt 50, a corona charging device 58 configured to apply a charge to the toner image transferred on the intermediate transfer belt 50 is disposed between a contact portion of the photoconductor drum 10 with the intermediate transfer belt 50 and a contact portion of the intermediate transfer belt 50 with the transfer paper 95 in a rotational direction of the intermediate transfer belt 50.

The developing device 40 is composed of a developing belt 41; and a black developing unit 45K, a yellow developing unit 45Y, a magenta developing unit 45M, and a cyan developing unit 45C, which are disposed around the developing belt 41. A developing unit 45 for each color includes a developer stored unit 42, a developer supplying roller 43, and a developing roller 44 (developer bearing member). Moreover, the developing belt 41, which is an endless belt, is stretched around a plurality of rollers, and is movable in a direction indicated by the arrow of the figures. A part of the developing belt 41 contacts with the photoconductor drum 10.

Next, a method for forming an image using the image forming apparatus 100A will be described hereinafter. The surface of the photoconductor drum 10 is uniformly charged by the charging roller 20. Then, the exposing device (not illustrated) exposes the surface of the photoconductor drum 10 to light, to form an electrostatic latent image. Next, the electrostatic latent image formed on the photoconductor drum 10 is developed using the toner supplied from a developer from the developing device 40, to form a toner image. The toner image formed on the photoconductor drum 10 is transferred (primarily transferred) onto the intermediate transfer belt 50, and is further transferred (secondary transferring) onto the transfer paper 95 by a transfer bias applied from the transfer roller 80. Meanwhile, a residual toner remaining on the surface of the photoconductor drum 10, in which the toner image is transferred to the intermediate transfer belt 50, is removed by the cleaning device 60, and a charge on the surface of the photoconductor drum 10 is eliminated by the charge-eliminating lamp 70.

FIG. 3 is a second example of an image forming apparatus used in the present invention. An image forming apparatus 100B has the same configuration as the image forming apparatus 100A, except that the developing belt 41 is not disposed, and that the black developing unit 45K, the yellow developing unit 45Y, the magenta developing unit 45M, and the cyan developing unit 45C are disposed directly facing the periphery of the photoconductor drum 10.

FIG. 4 illustrates a third example of an image forming apparatus used in the present invention. The image forming apparatus 100C is a tandem color image forming apparatus, and includes a copying device main body 150, a paper feeding table 200, a scanner 300, and an automatic document feeder (ADF) 400.

An intermediate transfer belt 50, which is an endless belt type, is disposed at a central part of the copying device main body 150. The intermediate transfer belt 50 is stretched around three rollers 14, 15, and 16, and can rotate in the direction indicated by the arrow in figures. Near the roller 15, a cleaning device 17 including a cleaning blade is disposed, and is configured to remove a residual toner on the intermediate transfer belt 50 in which the toner image is transferred to the recording paper. Image forming units for four colors (yellow, cyan, magenta, and black) 120Y, 120C, 120M, and 120K are aligned in the conveying direction so as to face the intermediate transfer belt 50 stretched around rollers 14 and 15.

Near the image forming unit 120, an exposing device 21 is disposed. Moreover, a secondary transfer belt 24 is disposed opposite to a side where the image forming unit 120 of the intermediate transfer belt 50 is disposed. The secondary transfer belt 24, which is an endless belt, is stretched around a pair of rollers 23. The recording paper conveyed on the secondary transfer belt 24 and the intermediate transfer belt 50 can contact each other between the roller 16 and the roller 23.

Near the secondary transfer belt 24, a fixing device 25 is disposed. The fixing device 25 includes a fixing belt 26 and a press roller 27, where the fixing belt 26, which is an endless belt, is stretched around a pair of rollers, and the press roller 27 is disposed so as to be pressed against the fixing belt 26. Here, a sheet inverting device 28 configured to invert the recording paper is disposed near the secondary transfer belt 24 and the fixing device 25, in order to form an image on both sides of the recording paper.

Next, a method for forming a full-color image using the image forming apparatus 100C will be described hereinafter. First, a color document is set on a document table 130 of the automatic document feeder (ADF) 400, or the automatic document feeder 400 is opened to set the color document on a contact glass 32 of the scanner 300, and the automatic document feeder 400 is closed.

When a start button is pushed, in the case where the color document has been set on the automatic document feeder 400, the color document is conveyed and transferred to the contact glass 32, and then the scanner 300 activates. Meanwhile, in the case the color document has been set on the contact glass 32, the scanner 300 activates immediately after that. Then, a first travelling body 33 including a light source and a second travelling body 34 including a mirror travel. At this time, the first travelling body 33 irradiates the document with light to form reflected light, the reflected light is reflected at the second travelling body 34, and then the reflected light is received at a reading sensor 36 through an imaging forming lens 35. Thus, the color document is read, to obtain black, yellow, magenta and cyan image information.

Each image information is transmitted to the image forming unit 120 for each color, to form a toner image for each color. As illustrated in FIG. 5, the image forming unit 120 for each color includes: a photoconductor drum 10; a charging roller 160 configured to uniformly charge the photoconductor drum 10; an exposing device configured to expose the photoconductor drum 10 to exposing light L based on image information for each color, to form an electrostatic latent image corresponding to form a color image; a developing device 61 configured to develop the electrostatic latent image with the toner for each color, to form a toner image of each of the color toners; a transfer roller 62 configured to transfer the toner image on the intermediate transfer belt 50; a cleaning device 63 including a cleaning blade; and a charge-eliminating lamp 64.

The toner image for each color formed on the image forming unit 120 for each color is transferred (primarily transferred), and are superposed on top of one another on an intermediate transfer member 50, which is stretched around rollers 14, 15, and 16, and is movable, to form a composite color image.

Meanwhile, on the paper feeding table 200, one of paper feeding rollers 142 is selectively rotated to feed a recording paper from one of the paper feeding cassettes 144 equipped in multiple stages in a paper bank 143. The sheet is separated one by one by a separation roller 145 and sent to a paper feeding path 146. The recording paper is conveyed by a conveying roller 147 and is guided to a paper feeding path 148 in the copying device main body 150, and stops by colliding with a registration roller 49. Alternatively, the paper feeding roller 142 is rotated to feed a recording paper on a manual feed tray 54. The recording paper is separated one by one by a separation roller 52 and is guided to a manual paper feeding path 53, and stops by colliding with the registration roller 49.

Note that, the registration roller 49 is generally used so as to be grounded, but it may also be used in a state that a bias is being applied for removing paper dust on the recording medium. Next, the registration roller 49 is rotated in accordance with the timing of the composite toner image formed on the intermediate transfer belt 50, the recording paper is fed to between the intermediate transfer belt 50 and the secondary transfer belt 24, to transfer (secondarily transfer) the composite toner image on the recording medium. Notably, a residual toner remaining on the intermediate transfer belt 50, in which the composite toner is transferred thereto, is removed by the cleaning device 17.

The recording medium on which the composite toner image is transferred is conveyed by the secondary transfer belt 24, and then the composite toner image is fixed by the fixing device 25. Next, a conveying path is switched by a switching claw 55, and the recording medium is discharged in a paper ejection tray 57 by a discharge roller 56. Alternatively, a conveying path is switched by the switching claw 55, and the recording medium is inverted by the inverting device 28, to form an image on the rear surface of the recording medium. Then the recording medium is discharged in the paper ejection tray 57 by the discharge roller 56.

An image forming method and an image forming apparatus of the present invention can provide an image having high quality for a long term.

EXAMPLES

The present invention will be more specifically described below referring to Examples. However, the present invention is not limited to these Examples. In the following description, "%" means "% by mass" and "part(s)" means "part(s) by mass."

Synthetic Example 1

—Synthesis of Polyester resin A-1—

A reaction container equipped with a nitrogen inlet tube, a water outlet tube, a stirrer, and a thermocouple was charged with bisphenol A ethylene oxide 2 mole adduct and bisphenol A propylene oxide 3 mol adduct in a molar ratio of 80/20 (bisphenol A ethylene oxide 2 mole adduct/bisphenol A propylene oxide 3 mol adduct), and isophthalic acid and adipic acid in a molar ratio of 70/30 (isophthalic acid/adipic acid) so as to be OH/COOH=1.33, followed by reacting together with 500 ppm of titanium tetraisopropoxide under normal pressure at 230° C. for 10 hours to thereby obtain a reaction product. Then, the reaction container was added with 26 parts of benzoic acid relative to 600 parts by mass of the total amount of the monomer used for reaction, followed by reacting together under reduced pressure in a range of from 10 mmHg through 15 mmHg for 5 hours. Thereafter, the reaction container was added with 11 parts of trimellitic anhydride, followed by reacting together under normal pressure at 180° C. for 3 hours, to thereby obtain <Polyester resin A-1>.

Synthetic Example 2

—Synthesis of Polyester Resin A-2—

<Polyester resin A-2> was obtained in the same manner as in Synthetic Example 1, except that the molar ratio of isophthalic acid to adipic acid was changed from 70/30 to 50/50.

Synthetic Example 3

—Synthesis of Polyester Resin A-3—

<Polyester resin A-3> was obtained in the same manner as in Synthetic Example 1, except that the molar ratio of isophthalic acid to adipic acid was changed from 70/30 to 60/40.

Synthetic Example 4

—Synthesis of Polyester Resin A-4—

<Polyester resin A-4> was obtained in the same manner as in Synthetic Example 1, except that the molar ratio of isophthalic acid to adipic acid was changed from 70/30 to 80/20.

Synthetic Example 5

—Synthesis of Polyester Resin A-5—

<Polyester resin A-5> was obtained in the same manner as in Synthetic Example 1, except that the molar ratio of bisphenol A ethylene oxide 2 mole adduct to bisphenol A propylene oxide 3 mol adduct was changed from 80/20 to 90/10, the molar ratio of isophthalic acid to adipic acid was changed from 70/30 to 90/10.

Synthetic Example 6

—Synthesis of Polyester Resin A-6—

<Polyester resin A-6> was obtained in the same manner as in Synthetic Example 1, except that the molar ratio of bisphenol A ethylene oxide 2 mole adduct to bisphenol A propylene oxide 3 mol adduct was changed from 80/20 to 50/50, the molar ratio of isophthalic acid to adipic acid was changed from 70/30 to 100/0, and the OH/COOH was changed from 1.33 to 1.29.

Synthetic Example 7

—Synthesis of Polyester Resin A-7—

<Polyester resin A-7> was obtained in the same manner as in Synthetic Example 1, except that the OH/COOH was changed from 1.33 to 1.35.

Synthetic Example 8

—Synthesis of Polyester Resin A-8—

<Polyester resin A-8> was obtained in the same manner as in Synthetic Example 1, except that the OH/COOH was changed from 1.33 to 1.31.

Synthetic Example 9

—Synthesis of Polyester Resin A-9—

<Polyester resin A-9> was obtained in the same manner as in Synthetic Example 1, except that the molar ratio of isophthalic acid to adipic acid was changed from 70/30 to 69/31, and the OH/COOH was changed from 1.33 to 1.25.

Synthetic Example 10

—Synthesis of Polyester Resin A-10—

<Polyester resin A-10> was obtained in the same manner as in Synthetic Example 1, except that the molar ratio of isophthalic acid to adipic acid was changed from 70/30 to 68/32, and the OH/COOH was changed from 1.33 to 1.23.

Synthetic Example 11

—Synthesis of Polyester Resin A-11—

<Polyester resin A-11> was obtained in the same manner as in Synthetic Example 1, except that the OH/COOH was changed from 1.33 to 1.21.

Synthetic Example 12

—Synthesis of Polyester Resin A-12—

<Polyester resin A-12> was obtained in the same manner as in Synthetic Example 1, except that the amount of trimellitic anhydride was changed from 11 parts to 2 parts.

Synthetic Example 13

—Synthesis of Polyester Resin A-13—

<Polyester resin A-13> was obtained in the same manner as in Synthetic Example 1, except that the amount of trimellitic anhydride was changed from 11 parts to 22 parts.

Synthetic Example 14

—Synthesis of Polyester Resin A-14—

<Polyester resin A-14> was obtained in the same manner as in Synthetic Example 1, except that the amount of benzoic acid was changed from 26 parts to 21 parts.

Synthetic Example 15

—Synthesis of Polyester Resin A-15—

<Polyester resin A-15> was obtained in the same manner as in Synthetic Example 1, except that the amount of benzoic acid was changed from 26 parts to 16 parts.

Synthetic Example 16

—Synthesis of Polyester Resin A-16—

A reaction container equipped with a nitrogen inlet tube, a water outlet tube, a stirrer, and a thermocouple was charged with bisphenol A ethylene oxide 2 mole adduct and bisphenol A propylene oxide 3 mol adduct in a molar ratio of 80/20 (bisphenol A ethylene oxide 2 mole adduct/bisphenol A propylene oxide 3 mol adduct), and isophthalic acid and adipic acid in a molar ratio of 70/30 (isophthalic acid/adipic acid) so as to be OH/COOH=1.4, followed by reacting together with 500 ppm of titanium tetraisopropoxide under normal pressure at 230° C. for 10 hours, to thereby obtain a reaction product. The resultant reaction product was dissolved into ethyl acetate, followed by washing with excessive methanol. Then, solvents were distilled off under reduced pressure. The reaction container was added with the resin that had been washed as described above, and 26 parts of benzoic acid relative to 600 parts by mass of the total amount of the monomer used for reaction, followed by reacting together under reduced pressure in a range of from 10 mmHg through 15 mmHg for 10 hours. Subsequently, the reaction container was added with 15 parts of trimellitic anhydride, followed by reacting under normal pressure at 180° C. for 3 hours, to thereby obtain <Polyester Resin A-16>.

Synthetic Example 17

—Synthesis of Polyester Resin A-17—

A reaction container equipped with a nitrogen inlet tube, a water outlet tube, a stirrer, and a thermocouple was charged with bisphenol A ethylene oxide 2 mole adduct and bisphenol A propylene oxide 3 mol adduct in a molar ratio of 80/20 (bisphenol A ethylene oxide 2 mole adduct/bisphenol A propylene oxide 3 mol adduct), and terephthalic acid, isophthalic acid and trimellitic anhydride in a molar ratio of 40/40/20 (terephthalic acid/isophthalic acid/trimellitic anhydride) so as to be OH/COOH=1.2, followed by reacting together with 500 ppm of titanium tetraisopropoxide under normal pressure at 230° C. for 10 hours. After further reacting under reduced pressure in a range of from 10 mmHg through 15 mmHg for 5 hours, the reaction container was added with 15 parts of trimellitic anhydride relative to 600 parts by mass of the total amount of the monomer used for reaction, followed by reacting together under normal pressure at 180° C. for 3 hours, to thereby obtain <Polyester resin A-17>.

—Production of Masterbatch (MB)—

HENSCHEL MIXER (manufactured by NIPPON COKE & ENGINEERING COMPANY, LIMITED) was charged with 1,200 parts of water, 540 parts of carbon black (PRINTEX 35, manufactured by Evonik Industries AG) (DBP oil absorption=42 mL/100 mg, pH=9.5), and 1,200 parts of <Polyester resin A-10>, followed by mixing together to thereby obtain a mixture. The mixture was kneaded at 150° C. for 30 min using a two-roll mill, followed by being roll-cooled and pulverized with a pulverizer, to thereby obtain <Masterbatch 1>.

Synthetic Example B-1

—Synthesis of Polyester Resin B-1—

A reaction container equipped with a nitrogen inlet tube, a water outlet tube, a stirrer, and a thermocouple was charged with bisphenol A ethylene oxide 2 mole adduct and bisphenol A propylene oxide 3 mol adduct in a molar ratio of 80/20 (bisphenol A ethylene oxide 2 mole adduct/bisphenol A propylene oxide 3 mol adduct), and isophthalic acid and adipic acid in a molar ratio of 70/30 (isophthalic acid/adipic acid) so as to be OH/COOH=1.33, followed by reacting together with 500 ppm of titanium tetraisopropoxide under normal pressure at 230° C. for 10 hours. After further reacting under reduced pressure in a range of from 10 mmHg through 15 mmHg for 5 hours, the reaction container was added with 11 parts of trimellitic anhydride relative to 600 parts by mass of the total amount of the monomer used for reaction, followed by reacting together under normal pressure at 180° C. for 3 hours, to thereby obtain <Polyester Resin B-1>.

Synthetic Example B-2

—Synthesis of Polyester Resin B-2—

<Polyester resin B-2> was obtained in the same manner as in Synthetic Example B-1, except that the molar ratio of isophthalic acid to adipic acid was changed from 70/30 to 68/32, and the OH/COOH was changed from 1.33 to 1.22.

Synthetic Example B-3

—Synthesis of Polyester Resin B-3—

<Polyester resin B-3> was obtained in the same manner as in Synthetic Example B-1, except that the OH/COOH was changed from 1.33 to 1.34.

Synthetic Example B-4

—Synthesis of Polyester Resin B-4—

<Polyester resin B-4> was obtained in the same manner as in Synthetic Example B-1, except that the molar ratio of bisphenol A ethylene oxide 2 mole adduct to bisphenol A propylene oxide 3 mol adduct was changed from 80/20 to 90/10, and the molar ratio of isophthalic acid to adipic acid was changed from 70/30 to 90/10.

Synthetic Example B-5

—Synthesis of Polyester Resin B-5—

<Polyester resin B-5> was obtained in the same manner as in Synthetic Example B-1, except that the molar ratio of isophthalic acid to adipic acid was changed from 70/30 to 58/42.

Example 1

<Preparation of Toner>

—Composition of Raw Materials—

Binder resin 1: <Polyester resin A-1> 85 parts

Binder resin 2: <Polyester resin A-17> 9 parts

Colorant: <Masterbatch 1> 7 parts

Charging control agent: BONTRON E-84 (manufactured by ORIENT CHEMICAL INDUSTRIES CO., LTD.) 1 part Wax: carnauba wax (WA-05, manufactured by CERARICA NODA Co., Ltd.) 6 parts Powder raw materials of a toner as described above were mixed well by a super mixer (SMV-200, manufactured by KAWATA MFG CO., Ltd.) to thereby obtain a toner powder-raw-material mixture. The toner powder-raw-material mixture was supplied to a raw material supplying hopper of Buss co-kneader (TCS-100, manufactured by Buss Co., Ltd.) to knead at a supply rate of 120 kg/h. The resultant kneaded product was roll-cooled on a double belt cooler, coarsely pulverized in a hammer mill, finely pulverized in a jet-stream pulverizer (I-20 jet mill, manufactured by Nippon Pneumatic Mfg. Co., Ltd.), and then finely classified by a wind-driven classifier (DS-20×DS-10 classifier, manufactured by Nippon Pneumatic Mfg. Co., Ltd.), to thereby produce <Toner base particles 1>.

—Mixing—

To the <Toner base particles 1>, was added hydrophobic silica (HDK-2000, manufactured by Wacker Chemie AG) in an amount of 1.5 parts relative to 100 parts of the base particles, followed by mixing with 20 L HENSCHEL MIXER (manufactured by NIPPON COKE & ENGINEERING COMPANY, LIMITED) at a circumferential velocity of 33 m/s for 5 min and sieving through a 500 mesh sieve, to thereby obtain <Toner 1>.

Example 2

<Toner 2> was produced in the same manner as in Example 1, except that <Polyester resin A-2> was used as the binder resin 1.

Example 3

<Toner 3> was produced in the same manner as in Example 1, except that <Polyester resin A-3> was used as the binder resin 1.

Example 4

<Toner 4> was produced in the same manner as in Example 1, except that <Polyester resin A-4> was used as the binder resin 1.

Example 5

<Toner 5> was produced in the same manner as in Example 1, except that <Polyester resin A-5> was used as the binder resin 1.

Example 6

<Toner 6> was produced in the same manner as in Example 1, except that <Polyester resin A-6> was used as the binder resin 1.

Example 7

<Toner 7> was produced in the same manner as in Example 1, except that <Polyester resin A-7> was used as the binder resin 1.

Example 8

<Toner 8> was produced in the same manner as in Example 1, except that <Polyester resin A-8> was used as the binder resin 1.

Example 9

<Toner 9> was produced in the same manner as in Example 1, except that <Polyester resin A-9> was used as the binder resin 1.

Example 10

<Toner 10> was produced in the same manner as in Example 1, except that <Polyester resin A-10> was used as the binder resin 1.

Example 11

<Preparation of Toner>

—Composition of Raw Materials—

Binder resin 1: <Polyester resin A-1> 45 parts

Binder resin 2: <Polyester resin A-11> 40 parts

Binder resin 3: <Polyester resin A-16> 9 parts

Colorant: <Masterbatch 1> 7 parts

Charging control agent: BONTRON E-84 (manufactured by ORIENT CHEMICAL INDUSTRIES CO., LTD.) 1 part Wax: carnauba wax (WA-05, manufactured by CERARICA NODA Co., Ltd.) 6 parts <Toner 11> was produced in the same manner as in Example 1, except that the above described Composition of raw materials was used.

Example 12

<Toner 12> was produced in the same manner as in Example 1, except that <Polyester resin A-12> was used as the binder resin 1.

Example 13

<Toner 13> was produced in the same manner as in Example 1, except that <Polyester resin A-13> was used as the binder resin 1.

Example 14

<Toner 14> was produced in the same manner as in Example 1, except that <Polyester resin A-14> was used as the binder resin 1.

Example 15

<Toner 15> was produced in the same manner as in Example 1, except that <Polyester resin A-15> was used as the binder resin 1.

Example 16

<Toner 16> was produced in the same manner as in Example 1, except that <Polyester resin A-16> was used as the binder resin 1.

Example 17

<Toner 17> was produced in the same manner as in Example 1, except that the amount of <Polyester resin A-17> was changed from 9 parts to 18 parts.

Example 18

<Toner 18> was produced in the same manner as in Example 1, except that the amount of <Polyester resin A-17> was changed from 9 parts to 12 parts.

Example 19

<Toner 19> was produced in the same manner as in Example 1, except that the amount of <Polyester resin A-17> was changed from 9 parts to 24 parts.

Example 20

<Toner 20> was produced in the same manner as in Example 1, except that the amount of <Polyester resin A-17> was changed from 9 parts to 26 parts.

Comparative Example 1

<Toner 21> was produced in the same manner as in Example 1, except that <Polyester resin B-1> was used as the binder resin 1.

Comparative Example 2

<Toner 22> was produced in the same manner as in Example 1, except that <Polyester resin B-2> was used as the binder resin 1.

Comparative Example 3

<Toner 23> was produced in the same manner as in Example 1, except that <Polyester resin B-3> was used as the binder resin 1.

Comparative Example 4

<Toner 24> was produced in the same manner as in Example 1, except that <Polyester resin B-4> was used as the binder resin 1.

Comparative Example 5

<Toner 25> was produced in the same manner as in Example 1, except that <Polyester resin B-5> was used as the binder resin 1.

Synthetic Example C

—Synthesis of Polyester Prepolymer—

A reaction vessel equipped with a cooling tube, a stirrer, and a nitrogen-introducing tube was charged with 720 parts of bisphenol A ethylene oxide 2 mole adduct, 90 parts of bisphenol A propylene oxide 2 mole adduct, 290 parts of terephthalic acid, and 1 part of tetrabutoxy titanate. The resultant mixture was allowed to react for 8 hours under a nitrogen stream at 230° C. under normal pressure while generated water is distilled off, and was further allowed to react for 7 hours under a reduced pressure in a range of from 10 mmHg through 15 mmHg, to thereby obtain <Intermediate polyester>. The <Intermediate polyester> was found to have a weight average molecular weight (Mw) of 9,300.

Next, a reaction vessel equipped with a cooling pipe, a stirring device, and a nitrogen-introducing tube was charged with 400 parts of the <Intermediate polyester>, 95 parts of isophorone diisocyanate, and 500 parts of ethyl acetate, and the resultant mixture was allowed to react under a nitrogen stream at 80° C. for 8 hours, to thereby obtain a 50% by mass solution of <Polyester prepolymer> containing a terminal isocyanate group in ethyl acetate. The resultant <Polyester prepolymer> was found to have a free isocyanate of 1.47% by mass.

Example 21

<Production of Toner 26 (Ester Elongation Method)>

—Preparation of Release Agent Dispersion Liquid—

A container equipped with a stirring bar and a thermometer was charged with 70 parts by mass of the carnauba wax (WA-05, manufactured by CERARICA NODA Co., Ltd.), 140 parts by mass of the <Polyester resin A-1>, and 290 parts by mass of ethyl acetate, following by heating to 75° C. with stirring, keeping at 75° C. for 1.5 hours, and cooling to 30° C. for 1 hour. The resultant was dispersed by a bead mill (ULTRA VISCOMILL, manufactured by AIMEX CO., Ltd.) under the following conditions: a liquid feed rate of 5 kg/hr, disc circumferential velocity of 6 m/s, zirconia beads having a diameter of 0.5 mm packed to 80% by volume, and 3 passes. Thus, <Release agent dispersion liquid> was obtained.

—Production of Oil Phase 1—

A container equipped with a thermometer and a stirring bar was charged with 113 parts by mass of the <Polyester resin A-1>, 88 parts by mass of the <Release agent dispersion liquid>, 42 parts by mass of <Masterbatch 1>, and 150 parts by mass of ethyl acetate, followed by predispersing in a stirrer. Then, the resultant was uniformly dissolved and dispersed by stirring with a TK homomixer (manufactured by PRIMIX Corporation) at 5,000 rpm, to thereby obtain <Oil phase 1>.

—Production of Aqueous Dispersion Liquid of Resin Particles—

A reaction container equipped with a stirring bar and a thermometer was charged with 600 parts by mass of water, 120 parts by mass of styrene, 100 parts by mass of methacrylic acid, 45 parts by mass of butyl acrylate, 10 parts by mass of a sodium salt of alkyl allyl sulfosuccinic acid (ELEMINOL JS-2, manufactured by Sanyo Chemical Industries, Ltd.), and 1 part by mass of ammonium persulfate, followed by stirring at 400 rpm for 20 min, to thereby obtain a white emulsion. The emulsion was heated until a system temperature reached 75° C., and was allowed to react for 6 hours. Then, 30 parts by mass of a 1% aqueous ammonium persulfate solution was further added thereto, and the resultant mixture was aged at 75° C. for 6 hour, to thereby obtain <Aqueous dispersion liquid of resin particles>. The resin particles contained in the <Aqueous dispersion liquid of resin particles> were found to have a volume average particle diameter of 60 nm. The resin was found to have the weight average molecular weight of 140,000 and the Tg of 73° C.

—Preparation of Aqueous Phase—

Water (990 parts), 83 parts of the <Aqueous dispersion liquid of resin particles>, 37 parts of a 48.5% by mass aqueous solution of sodium dodecyldiphenyl ether disulfonate (ELEMINOL MON-7, manufactured by Sanyo Chemical Industries Ltd.), and 90 parts of ethyl acetate were mixed and stirred, to thereby obtain <Aqueous phase>.

—Emulsification or Dispersion—

To 393 parts by mass of the <Oil phase 1>, were added 58 parts by mass of a 50% by mass solution of the <Polyester prepolymer> in ethyl acetate and 3.5 parts by mass of a 50% by mass solution of isophoronediamine in ethyl acetate. The resultant was uniformly dissolved and dispersed by stirring with a TK homomixer (manufactured by PRIMIX Corporation) at 5,000 rpm, to thereby obtain <Oil phase 1'>. Then, another container equipped with a stirrer and a thermometer was charged with 550 parts by mass of the <Aqueous phase>, and then added with the <Oil phase 1'> with stirring by a TK homomixer (manufactured by PRIMIX Corporation) at 11,000 rpm to thereby emulsify together for 1 min. Thus, <Emulsified slurry 1> was obtained.

—Desolvation, Washing, and Drying—

A container equipped with a stirrer and a thermometer was charged with the <Emulsified slurry 1>, followed by desolvating at 30° C. for 8 hours, to thereby obtain <Slurry 1>. The resultant <Slurry 1> was kept at 40° C. for 4 hours, followed by being filtered under reduced pressure, to thereby obtain a filtration cake. Then, the resultant was subjected twice to a series of washing steps (1) to (3) described below to thereby obtain Filtration cake 1:

(1) 100 parts by mass of ion-exchanged water was added to the filtration cake, followed by mixing with a TK Homomixer (at 6,000 rpm for 5 min), and then filtering.

(2) 100 parts by mass of ion-exchanged water was added to the filtration cake obtained in (1), followed by mixing with a TK Homomixer (at 6,000 rpm for 5 min). To this, was added 1% by mass hydrochloric acid with stirring until pH reached about 3.3, followed by further stirring for 1 hour at the same pH and filtering.

(3) 300 parts by mass of ion-exchanged water was added to the filtration cake obtained in (2), followed by mixing with a TK Homomixer (at 6,000 rpm for 5 min) and then filtering.

Next, the obtained Filtration cake 1 was dried with an air-circulating drier at 40° C. for 48 hours, and then sieved with a 75 μm mesh sieve, to thereby obtain <Toner base particles 26>.

The resultant <Toner base particles 26> was mixed and sieved in the same manner as in Example 1 to thereby obtain <Toner 26>.

Example 22

<Production of Toner 27 (Ester Elongation Method)>

<Toner 27> was produced in the same manner as in Example 21, except that the resultant slurry after desolvation was kept at 40° C. for 6 hours.

Example 23

<Production of Toner 28 (Ester Elongation Method)>

<Toner 28> was produced in the same manner as in Example 21, except that the resultant slurry after desolvation was kept at 40° C. for 10 hours.

Example 24

<Production of Toner 29 (Ester Elongation Method)>

<Toner 29> was produced in the same manner as in Example 21, except that the resultant slurry after desolvation was kept at 45° C. for 10 hours.

Example 25

<Production of Toner 30 (Ester Elongation Method)>

<Toner 30> was produced in the same manner as in Example 21, except that the resultant slurry after desolvation was kept at 45° C. for 12 hours.

<Oil phase 2'>

<Oil phase 2'> was obtained in the same manner as in the <Oil phase 1'>, except that 58 parts by mass of a 50% by mass solution of the <Polyester prepolymer> in ethyl acetate and 2.0 parts by mass of a 50% by mass solution of isophoronediamine in ethyl acetate were added to 393 parts by mass of the <Oil phase 1>.

<Oil phase 3'>

<Oil phase 3'> was obtained in the same manner as in the <Oil phase 1'>, except that 58 parts by mass of a 50% by mass solution of the <Polyester prepolymer> in ethyl acetate and 2.5 parts by mass of a 50% by mass solution of isophoronediamine in ethyl acetate were added to 393 parts by mass of the <Oil phase 1>.

<Oil phase 4'>

<Oil phase 4'> was obtained in the same manner as in the <Oil phase 1'>, except that 58 parts by mass of a 50% by mass solution of the <Polyester prepolymer> in ethyl acetate and 3.0 parts by mass of a 50% by mass solution of isophoronediamine in ethyl acetate were added to 393 parts by mass of the <Oil phase 1>.

<Oil phase 5'>

<Oil phase 5'> was obtained in the same manner as in the <Oil phase 1'>, except that 58 parts by mass of a 50% by mass solution of the <Polyester prepolymer> in ethyl acetate and 4.0 parts by mass of a 50% by mass solution of isophoronediamine in ethyl acetate were added to 393 parts by mass of the <Oil phase 1>.

<Oil phase 6'>

<Oil phase 6'> was obtained in the same manner as in the <Oil phase 1'>, except that 58 parts by mass of a 50% by mass solution of the <Polyester prepolymer> in ethyl acetate and 5.0 parts by mass of a 50% by mass solution of isophoronediamine in ethyl acetate were added to 393 parts by mass of the <Oil phase 1>.

Example 26

<Production of Toner 31>

<Toner 31> was produced in the same manner as in Example 23, except that the <Oil phase 2'> was used for emulsification or dispersion.

Example 27

<Production of Toner 32>

<Toner 32> was produced in the same manner as in Example 23, except that the <Oil phase 3'> was used for emulsification or dispersion.

Example 28

<Production of Toner 33>

<Toner 33> was produced in the same manner as in Example 23, except that the <Oil phase 4'> was used for emulsification or dispersion.

Example 29

<Production of Toner 34>

<Toner 34> was produced in the same manner as in Example 23, except that the <Oil phase 5'> was used for emulsification or dispersion.

Example 30

<Production of Toner 35>

<Toner 35> was produced in the same manner as in Example 23, except that the <Oil phase 6'> was used for emulsification or dispersion.

(Measurement)

The above toners of Examples and Comparative Examples were subjected to the following measurements.

<IR Measurement>

$P_{urethane}/P_{urea}$ was determined based on spectra as measured by a Kbr method (full transmission method) with Fourier transform infrared spectrophotometer (Avatar 370, manufactured by Thermo Electron Corporation). Measurement conditions were as follows.

<Measurement Condition>

Measurement range: 4,000 $cm^{-1}$ through 400 $cm^{-1}$

Resolution: 4 $cm^{-1}$

Cumulative number: 4

Toner concentration: 0.420±0.003% by mass

Notably, intensity was calculated as described above.

<GPC Measurement>

A molecular weight distribution of THF-soluble components in each of the toners as measured by GPC was determined as follows.

Gel permeation chromatography (GPC) measuring device: GPC-8220GPC (manufactured by Tosoh Corporation)

Column: TSK-GEL SUPER HZ 2000, TSK-GEL SUPER HZ 2500, and TSK-GEL SUPER HZ 3000

Temperature: 40° C.

Solvent: tetrahydrofuran (THF)

Flow rate: 0.35 mL/min

Sample: THF sample solution having a concentration adjusted to 0.15% by mass

Pretreatment of sample: a toner was dissolved in THF (containing a stabilizer, manufactured by Wako Pure Chemical Industries, Ltd.) at 0.15% by mass, followed by filtering through a 0.45 μm filter. The resultant filtrate was used as the sample.

The measurement can be performed by injecting a range of from 10 μL through 200 μL of the THF sample solution. As for the measurement of the molecular weight of the sample, a molecular weight distribution of the sample was calculated from the relationship between the number of counts and the logarithmic value of the calibration curve prepared from several monodispersed polystyrene standard samples.

As for the polystyrene standard sample for preparing the calibration curve, polystyrene standard samples having molecular weights of $6'10^2$, $2.1'10^3$, $4'10^3$, $1.75'10^4$, $5.1'10^4$, $1.1'10^5$, $3.9'10^5$, $8.6'10^5$, $2'10^6$ and $4.48'10^6$ (manufactured by Pressure Chemical Company or Tosoh Corporation) were used. As for a detector, a refractive index (RI) detector was used.

The weight average molecular weight Mw and the ratio of the weight average molecular weight Mw to the number average molecular weight Mn (Mw/Mn) were determined from the resultant molecular weight distribution curve.

<Viscoelasticity>

The tan δ was measured with a dynamic viscoelasticity measuring device (ARES, manufactured by TA instruments). Specifically, a sample was molded into a pellet having a diameter of 8 mm and a thickness in a range of from 1 mm through 2 mm. Then, the resultant pellet was fixed on a parallel plate having a diameter of 8 mm, stabilized at 40° C., and heated to 200° C. at a frequency of 1 Hz (6.28 rad/s), a strain amount of 0.1% (controlled strain mode), and a heating rate of 2.0° C./min.

At each of measurement temperatures, the ratio (G"/G') of the storage modulus G' (Pa) to the loss viscosity G" (Pa) was calculated, which was determined as tan S.

Notably, the values of "tan δ" described in the following tables represent the minimum tan δ value and the maximum tan δ value in a measurement temperature range in a range of from 120° C. through 160° C.

<Soxhlet Extraction with THF>

Two grams of the toner was placed in a thimble having an internal diameter of 24 mm, which was then set in an extraction tube. A flask was charged with 200 mL of THF, followed by performing Soxhlet extraction for 10 hours. As for the Soxhlet extraction, a commonly used Soxhlet extractor was used. One set of the flask equipped with a condenser was placed in a heating mantle. The THF was allowed to reflux at 80° C. and added dropwise from the condenser to the toner so that the THF-soluble components in the toner were extracted in the flask, to thereby obtain an extraction liquid. The extraction liquid was dried for 48 hours at 38° C. to obtain <Extract>.

For the resultant <Extract>, the glass transition temperature Tg was measured with DSC-6220R (manufactured by Seiko Instruments Inc.). A sample was heated from room temperature to 150° C. at a temperature rising rate of 10° C./min; left to stand at 150° C. for 10 min; cooled to room temperature; left to stand at room temperature for 10 min; and then heated again to 150° C. at a temperature rising rate of 10° C./min. The Tg was determined from the base line at a temperature equal to or lower than the glass transition temperature and a curved line portion at a height which corresponds to 1/2 of the distance from the base line at a temperature equal to or lower than the glass transition temperature to the base line at a temperature equal to or higher than the glass transition temperature.

For the resultant <Extract>, the acid value AV (KOHmg/g) and the hydroxyl value OHV (KOHmg/g) were determined. Notably, the acid value and the hydroxyl value were determined according to JIS K0070-1992 and JIS K0070-1966.

<Soxhlet Extraction with Ethyl Acetate>

A common Soxhlet extractor was used for the Soxhlet extraction. Firstly, 0.5 g of a toner was weighed precisely into a thimble for Soxhlet extraction which had been weighed precisely, 200 g of ethyl acetate was added into a 300 mL flat-bottom flask, and the thimble was placed in a Soxhlet extraction tube. The flat-bottom flask, the Soxhlet extraction tube, and a cooling pipe were coupled to each other. The flat-bottom flask was heated in a mantle heater to thereby perform extraction for 10 hours from the beginning of boiling of the ethyl acetate in the flask. After the extraction, the thimble was washed with ethyl acetate thoroughly, and then the ethyl acetate serving as a solvent was dried thoroughly. The amount of ethyl acetate insoluble components contained in the toner was calculated in percentage from the initial sample weight, the initial thimble weight, and the extraction residue after extraction and drying.

<Flowtester>

The 1/2 method softening point (T1/2) was determined from a flow curve measured with an elevated flowtester (CFT-500, manufactured by SHIMADZU CORPORATION). Measurement conditions were as follows.

<Measurement Condition>

Load: 10 kg/cm$^2$

Heating rate: 3.0° C./min

Diameter of die: 0.50 mm

Length of die: 1.0 mm

Measurement temperature: from 40° C. through 200° C.

(Evaluation Method and Evaluation Result)

The toners of Examples and Comparative Examples were subjected to the following evaluations. Evaluation results are presented in Tables 1 to 3.

<Low Temperature Fixing Property>

An image forming apparatus ("IPSIO COLOR 8100"; manufactured by Ricoh Company, Ltd.), which had been modified and tuned to an oil-less fixing system, was used for evaluation. Sheets of thick paper ("paper for copying and printing <135>"; manufactured by RICOH JAPAN Corp.) were set to the apparatus. The apparatus was adjusted to develop a solid image with a toner at 1.0±0.1 mg/cm$^2$. A fixing roll temperature at which a residual rate of image density after the resultant fixed image was rubbed with a pad was 70% or higher was determined as a fixing lower limit temperature.

<Evaluation Criteria>

A: Fixing lower limit temperature was lower than 120° C.

B: Fixing lower limit temperature was 120° C. or higher but lower than 135° C.

C: Fixing lower limit temperature was 135° C. or higher but lower than 150° C.

D: Fixing lower limit temperature was 150° C. or higher.

<Heat Resistant Storability>

The toners were stored at 50° C. for 8 hours, followed by sieving through a 42 mesh sieve for 2 min. A residual rate of the toner remaining on the sieve was determined as an index of the heat resistant storability. The heat resistant storability was evaluated in 4 grades according to the following criteria. "A" and "B" represent a satisfactory level, "C" represents a practically acceptable level despite of its slightly poor storability, and "D" represents a practically problematic level.

<Evaluation Criteria>

A: lower than 10%

B: 10% or higher but lower than 20%

C: 20% or higher but lower than 30%

D: 30% or higher

<Charging Stability>

The durability was tested using each of developers. A character and image pattern at an image area rate of 12% was continuously output on 100,000 sheets to evaluate a change of a charging amount before and after the output. A small amount of the developer was taken from a sleeve, and the change of the charge amount was determined by the blow-off method and evaluated according to the following evaluation criteria.

<Evaluation Criteria>

A: Change of charging amount is less than 3 μc/g.

B: Change of charging amount is 3 μc/g or higher but lower than 6 μc/g.

C: Change of charging amount is 6 μc/g or higher but lower than 10 μc/g.

D: Change of charging amount is 10 μc/g or higher.

<Separation Stability>

A force required to peel off a recording medium from a fixing roller (i.e., separation resistance force) was measured by a measuring device for pressing force of recording medium illustrated in FIG. 6, to thereby evaluate the separation stability.

In the measuring device for pressing force of recording medium, a recording medium S is conveyed while the recording medium S is pressed against a measuring pawl 405 with a load 406 being applied. At this time, the pressing force of the recording medium is read by a load cell 403 that is mounted on the other end of the measuring pawl 405 through a fulcrum 404. A value read by the load cell 403 is separation resistance force. The measuring pawl 405 is mounted on a side of a fixing roller 401 which is just behind a nip portion located between a fixing roller 401 and a pressure roller 402.

The measuring device for pressing force of recording medium was secured on a fixing portion of the image forming apparatus using a tool so that the measuring pawl 405 was properly disposed. A4 paper (TYPE 6200, manufactured by Ricoh Company, Ltd.) was used as the recording medium S to form an unfixed solid image having a size of 3 cm' 10 cm at the toner deposition amount of 0.85±0.01 mg/cm$^2$ so as to be located 3 cm from the upper end and centered in the horizontal direction and. The separation resistance force generated during fixing the unfixed solid image at a fixing temperature of 160° C. was measured and evaluated according to the following criteria. "A" represents very good, "B" represents good, "C" represents acceptable, and "D" represents practically unacceptable.

<Evaluation Criteria>

A: The separation resistance force is less than 200 gf.

B: The separation resistance force is 200 gf or more but 300 gf or less.

C: The separation resistance force is more than 300 gf but 400 gf or less.

D: The separation resistance force is more than 400 gf.

<Maximum Glossiness>

A copying test was performed on POD GLOSS COATED PAPER (basis weight: 128 g/m$^2$, manufactured by Oji Paper Co., Ltd.) using an image forming apparatus. As an image for glossiness evaluation, a solid image having a size of 3 cm' 10 cm was formed on POD GLOSS COATED PAPER (basis weight: 128 g/m$^2$, manufactured by Oji Paper Co., Ltd.) at the toner deposition amount of 0.40±0.02 mg/cm$^2$ so as to be located 3 cm from the upper end and centered in the horizontal direction and. The solid image was fixed under the following conditions: the paper-feeding linear velocity: 280 mm/s, the surface pressure: 1.2 kgf/cm$^2$, the nip width: 11 mm, and the fixing temperature: every 5° C. in the range of from 160° C. through 180° C., which was used as the image for glossiness evaluation. The 60 degree-glossiness was measured with the glossmeter (VG-7000, manufactured by NIPPON DENSHOKU INDUSTRIES CO., LTD.) at each of any ten points on the image. The average value of the 60 degree-glossiness was determined as glossiness. The maximum glossiness value on the image for glossiness evaluation at each fixing temperature was determined as the maximum glossiness and evaluated according to the following criteria. "A" represents very good, "B" represents good, "C" represents acceptable, and "D" represents practically unacceptable.

<Evaluation Criteria>

A: The maximum glossiness was 30% or higher.

B: The maximum glossiness was 25% or higher but lower than 30%.

C: The maximum glossiness was 20% or higher but lower than 25%.

D: The maximum glossiness was lower than 20%.

<Gloss Unevenness>

The image forming apparatus of the present invention was used to sequentially form the first image and the second solid image of a chart for evaluation (FIG. 7) on MONDI COLOR COPY 300 (basis weight: 300 g/m$^2$, manufactured by Mondi plc) at the toner deposition amount of 1.00±0.03 mg/cm$^2$. The resultant image were fixed with the fixing temperature being varied under the following conditions: the paper-feeding linear velocity: 400 mm/s, the surface pressure: 1.6 kgf/cm$^2$, the nip width: 15 mm, and the perimeter of the fixing belt: 240 mm. The second solid images fixed at each fixing temperature were determined as the images for gloss unevenness. The 60 degree-glossiness was measured at each of any three points on each of the evaluation portion (1) 511 and the evaluation portion (2) 513 illustrated in FIG. 7 using a glossmeter (VG-7000, manufactured by NIPPON DENSHOKU INDUSTRIES CO., LTD.). The resultant 60 degree-glossiness was averaged to determine a fixing temperature at which a difference in the average glossiness between (1) and (2) was 20% or more.

<Evaluation Criteria>

A: The fixing temperature at which the difference in average glossiness is 20% or more is 190° C. or higher; or the difference in the average glossiness is less than 20%.

B: The fixing temperature at which the difference in the average glossiness is 20% or more is 180° C. or higher but lower than 190° C.

C: The fixing temperature at which the difference in the average glossiness is 20% or more is 170° C. or higher but lower than 180° C.

D: The fixing temperature at which the difference in the average glossiness is 20% or more is lower than 170° C.

<Overall Judgement>

Evaluation criteria for overall judgement was as follows. "AA" represents extremely good, "A" represents very good, "B" represents good, "C" represents acceptable, and "D" represents practically unacceptable. "AA," "A," "B," and "C" are determined as pass, and "D" is determined as fail.

<Evaluation Criteria>

AA: There are three or more A, and there is neither C nor D.

A: There are two A, and there is neither C nor D.

B: Neither the condition for AA nor the condition for A is met, nor there is neither C nor D.

C: There are one or more C, and there is no D.

D: There are one or more D.

Results are presented in Tables 1 to 4-2. Notably, "Insoluble components in toner [% by mass]" in Tables 2-1, 3-1, and 4-1 denotes a gel content of insoluble components obtained through Soxhlet extraction of the toner with ethyl acetate.

TABLE 1

| | | Toner extract through Soxhlet extraction | | | | | Difference | Low | | | |
|---|---|---|---|---|---|---|---|---|---|---|---|
| Example | Toner | Tg (° C.) | Mw (—) | Mw/Mn (—) | AV (KOH mg/g) | OHV (KOH mg/g) | between GPC peak intensities | temperature fixing property | Heat resistant storability | Charging stability | Overall judgement |
| Ex. 1 | Toner 1 | 45 | 4530 | 2.3 | 12 | 8 | 3 | A | B | B | B |
| Ex. 2 | Toner 2 | 35 | 4320 | 2.3 | 14 | 8 | 5 | A | C | B | C |
| Ex. 3 | Toner 3 | 40 | 4350 | 2.3 | 13 | 8 | 5 | A | C | B | C |
| Ex. 4 | Toner 4 | 51 | 4780 | 2.3 | 14 | 8 | 3 | B | B | A | B |
| Ex. 5 | Toner 5 | 58 | 4280 | 2.3 | 12 | 8 | 3 | B | B | B | B |
| Ex. 6 | Toner 6 | 63 | 5250 | 2.3 | 11 | 8 | 3 | C | A | A | C |
| Ex. 7 | Toner 7 | 45 | 3310 | 2.3 | 14 | 8 | 8 | A | C | B | C |
| Ex. 8 | Toner 8 | 45 | 5470 | 2.4 | 12 | 8 | 3 | B | B | B | B |
| Ex. 9 | Toner 9 | 45 | 8600 | 2.5 | 11 | 8 | 3 | C | B | A | C |
| Ex. 10 | Toner 10 | 45 | 11230 | 2.8 | 12 | 8 | 2 | C | A | A | C |
| Ex. 11 | Toner 11 | 45 | 8550 | 7.0 | 12 | 8 | 4 | C | B | B | C |
| Ex. 12 | Toner 12 | 45 | 4520 | 2.3 | 3 | 8 | 3 | B | B | A | B |
| Ex. 13 | Toner 13 | 45 | 4480 | 2.3 | 21 | 8 | 5 | A | B | B | B |
| Ex. 14 | Toner 14 | 45 | 4760 | 2.3 | 13 | 16 | 12 | B | C | C | C |
| Ex. 15 | Toner 15 | 45 | 4660 | 2.3 | 13 | 23 | 26 | A | C | C | C |
| Ex. 16 | Toner 16 | 45 | 9120 | 2.2 | 12 | 11 | 18 | C | C | A | C |
| Comp. Ex. 1 | Toner 21 | 45 | 4620 | 2.3 | 12 | 55 | 45 | A | C | D | D |
| Comp. Ex. 2 | Toner 22 | 49 | 15100 | 2.3 | 11 | 36 | 32 | D | B | C | D |
| Comp. Ex. 3 | Toner 23 | 45 | 3980 | 2.3 | 12 | 62 | 56 | A | D | D | D |
| Comp. Ex. 4 | Toner 24 | 58 | 4710 | 2.3 | 13 | 54 | 38 | C | B | D | D |
| Comp. Ex. 5 | Toner 25 | 38 | 4620 | 2.3 | 11 | 58 | 43 | A | D | D | D |

TABLE 2-1

| | | Toner extract through Soxhlet extraction with THF | | | | | Insoluble | Difference | tan δ at 120° C. to 160° C. | |
|---|---|---|---|---|---|---|---|---|---|---|
| Example | Toner | Tg (° C.) | Mw (—) | Mw/Mn (—) | AV (KOH mg/g) | OHV (KOH mg/g) | components in toner [% by mass] | between GPC peak intensities | Minimum value | Maximum value |
| Ex. 17 | Toner 17 | 45 | 4530 | 2.3 | 12 | 8 | 21 | 3 | 0.67 | 0.83 |
| Ex. 18 | Toner 18 | 45 | 4530 | 2.3 | 12 | 8 | 10 | 3 | 0.78 | 1.05 |
| Ex. 19 | Toner 19 | 45 | 4530 | 2.3 | 12 | 8 | 30 | 3 | 0.40 | 0.42 |
| Ex. 20 | Toner 20 | 45 | 4530 | 2.3 | 12 | 8 | 33 | 3 | 0.32 | 0.36 |

TABLE 2-2

| Example | Low temperature fixing property | Heat resistant storability | Charging stability | Separation stability | Maximum glossiness | Gloss unevenness | Overall judgement |
|---|---|---|---|---|---|---|---|
| Ex. 17 | B | B | B | A | A | A | AA |
| Ex. 18 | A | B | B | B | A | C | C |
| Ex. 19 | B | B | B | A | B | A | A |
| Ex. 20 | C | A | B | A | C | A | C |

TABLE 3-1

| Example | Toner | Toner extract through Soxhlet extraction with THF: Tg (° C.) | Mw (—) | Mw/Mn (—) | AV (KOH mg/g) | OHV (KOH mg/g) | Insoluble components in toner [% by mass] | T½ (° C.) | Difference between GPC peak intensities | tan δ at 120° C. to 160° C.: Minimum value | Maximum value |
|---|---|---|---|---|---|---|---|---|---|---|---|
| Ex. 21 | Toner 26 | 45 | 4530 | 2.3 | 12 | 8 | 10 | 102 | 3 | 0.74 | 0.98 |
| Ex. 22 | Toner 27 | 45 | 4530 | 2.3 | 12 | 8 | 13 | 105 | 3 | 0.70 | 0.91 |
| Ex. 23 | Toner 28 | 45 | 4530 | 2.3 | 12 | 8 | 18 | 115 | 3 | 0.61 | 0.77 |
| Ex. 24 | Toner 29 | 45 | 4530 | 2.3 | 12 | 8 | 23 | 125 | 3 | 0.43 | 0.49 |
| Ex. 25 | Toner 30 | 45 | 4530 | 2.3 | 12 | 8 | 26 | 128 | 3 | 0.34 | 0.37 |

TABLE 3-2

| Example | $P_{urethane}/P_{urea}$ | Low temperature fixing property | Heat resistant storability | Charging stability | Separation stability | Maximum glossiness | Gloss unevenness | Overall judgement |
|---|---|---|---|---|---|---|---|---|
| Ex. 21 | 12 | A | B | B | C | A | B | C |
| Ex. 22 | 10 | A | B | B | B | A | B | A |
| Ex. 23 | 9 | B | B | B | A | A | A | AA |
| Ex. 24 | 8 | C | B | B | A | B | A | C |
| Ex. 25 | 7 | C | B | B | A | C | A | C |

TABLE 4-1

| Example | Toner | Toner extract through Soxhlet extraction with THF: Tg (° C.) | Mw (—) | Mw/Mn (—) | AV (KOH mg/g) | OHV (KOH mg/g) | Insoluble components in toner [% by mass] | T½ (° C.) | Difference between GPC peak intensities | tan δ at 120° C. to 160° C.: Minimum value | Maximum value |
|---|---|---|---|---|---|---|---|---|---|---|---|
| Ex. 26 | Toner 31 | 45 | 4530 | 2.3 | 12 | 8 | 8 | 102 | 3 | 0.92 | 1.05 |
| Ex. 27 | Toner 32 | 45 | 4530 | 2.3 | 12 | 8 | 9 | 110 | 3 | 0.75 | 0.99 |
| Ex. 28 | Toner 33 | 45 | 4530 | 2.3 | 12 | 8 | 19 | 116 | 3 | 0.63 | 0.73 |
| Ex. 29 | Toner 34 | 45 | 4530 | 2.3 | 12 | 8 | 23 | 120 | 3 | 0.49 | 0.58 |
| Ex. 30 | Toner 35 | 45 | 4530 | 2.3 | 12 | 8 | 26 | 130 | 3 | 0.35 | 0.39 |

TABLE 4-2

| Example | $P_{urethane}/P_{urea}$ | Low temperature fixing property | Heat resistant storability | Charging stability | Separation stability | Maximum glossiness | Gloss unevenness | Overall judgement |
|---|---|---|---|---|---|---|---|---|
| Ex. 26 | 27 | A | C | B | C | A | C | C |
| Ex. 27 | 22 | A | B | B | B | A | B | A |
| Ex. 28 | 13 | A | A | B | A | A | A | AA |
| Ex. 29 | 9 | B | A | B | A | A | A | AA |
| Ex. 30 | 7 | C | A | B | A | C | A | C |

As clearly can be seen from evaluation results in Tables 1, 2-2, 3-2, and 4-2, the toners of Examples 1 to 30 are sufficiently excellent in all of the low temperature fixing property, the heat resistant storability, and the charging stability. In contrast, the toner of Comparative Examples 1 to 5 are practically problematic in at least one of the low temperature fixing property, the heat resistant storability, and the charging stability.

As clearly can be seen from evaluation results in Tables 2-1 and 2-2, the toners of Examples 17 to 20 resulted in high gloss images being excellent in the separation stability. In particular, Examples 17 to 19 in which the gel content of insoluble components obtained through Soxhlet extraction with ethyl acetate fell within the suitable range resulted in excellent results.

As clearly can be seen from evaluation results in Tables 3-1 and 3-2, in the case of producing the toners through the ester elongation method, Examples 22 to 24 in which the 1/2 method softening point (T1/2) fell within the suitable range in the flow curve of the toners as measured with the elevated flowtester resulted in the toners having good low temperature fixing property, heat resistant storability, and charging stability, as well as high gloss images being excellent in the separation stability.

As clearly can be seen from evaluation results in Tables 4-1 to 4-2, in the case of controlling the elongation and cross-linking reaction of the polyester prepolymer, Examples 27 to 29 in which the $P_{urethane}/P_{urea}$ fell within the suitable range in the spectra of the toners as measured by the KBr method (full transmission method) resulted in the toners having good low temperature fixing property, heat resistant storability, and charging stability, as well as high gloss images being excellent in the separation stability. Of these, Example 28 achieved an especially excellent result.

DESCRIPTION OF THE REFERENCE NUMERAL

10 electrostatic latent image bearer (photoconductor drum)
10K black electrostatic latent image bearer
10Y yellow electrostatic latent image bearer
10M magenta electrostatic latent image bearer
10C cyan electrostatic latent image bearer
14 roller
15 roller
16 roller
17 cleaning device
18 image forming means
20 charging roller
21 exposing device
22 secondary transfer device
23 roller
24 secondary transfer belt
25 fixing device
26 fixing belt
27 press roller
28 sheet inverting device
32 contact glass
33 first travelling body
34 second travelling body
35 imaging forming lens
36 reading sensor
40 developing device
41 developing belt
42K developer stored unit
42Y developer stored unit
42M developer stored unit
42C developer stored unit
43K developer supplying roller
43Y developer supplying roller
43M developer supplying roller
43C developer supplying roller
44K developing roller
44Y developing roller
44M developing roller
44C developing roller
45K black developing unit
45Y yellow developing unit
45M magenta developing unit
45C cyan developing unit
49 registration roller
50 intermediate transfer belt
51 roller
52 separation roller
53 manual paper feeding path
54 manual feed tray
55 switching claw
56 discharge roller
57 paper ejection tray
58 corona charging device
60 cleaning device
61 developing device
62 transfer roller
63 cleaning device
64 charge-eliminating lamp
70 charge-eliminating lamp
80 transfer roller
90 cleaning device
95 transfer paper
100A, 100B, 100C image forming apparatus
120 image forming unit
130 document table
142 paper feeding roller
143 paper bank
144 paper feeding cassette
145 separation roller
146 paper feeding path
147 conveying roller
148 paper feeding path
150 copying device main body
160 charging roller
200 paper feeding table
300 scanner
400 automatic document feeder (ADF)
401 fixing roller
402 pressure roller
403 load cell
404 fulcrum
405 measuring pawl
406 load
500 perimeter of fixing belt
501 non-image portion
503 image portion
511 evaluation portion (1)
513 evaluation portion (2)
S recording medium
N nip

The invention claimed is:

1. A toner comprising:

a binder resin; and a release agent, wherein the toner has a difference of 30 or less between a maximum value and a minimum value among peak intensities in a range of Molecular weight M±300 where Molecular weight M is a molecular weight selected from a range of from 300 through 5,000 in a molecular weight distribution of tetrahydrofuran (THF)-soluble components in the toner as measured by gel permeation chromatography (GPC), and wherein the peak intensities are defined as relative values assuming a maximum peak value in molecular weights of 20,000 or less is 100, in a molecular weight distribution curve taking an intensity as a vertical axis and a molecular weight as a horizontal axis as measured by GPC.

2. The toner according to claim 1, wherein a toner extract obtained by drying an extraction liquid obtained through Soxhlet extraction of the toner with THF has glass transition temperature Tg in a range of from 40° C. through 60° C., and, in a molecular weight distribution of the toner extract as measured by GPC, has a weight average molecular weight Mw in a range from 3,000 through 10,000 and a ratio of the weight average molecular weight (Mw) to a number average molecular weight (Mn) of 6 or less.

3. The toner according to claim 2, wherein a toner extract obtained by drying an extraction liquid obtained through Soxhlet extraction of the toner with THF has the glass transition temperature Tg in a range of from 42° C. through 50° C., and, in the molecular weight distribution of the toner extract as measured by GPC, has the weight average molecular weight Mw in a range of 3,500 through 5,000 and the ratio of the weight average molecular weight (Mw) to the number average molecular weight (Mn) of 2.5 or less.

4. The toner according to claim 1, wherein tan δ, which is a ratio (G"/G') of storage modulus G' (Pa) to loss viscosity G" (Pa) obtained from a viscoelasticity measurement of the toner, is in a range of from 0.40 through 1.00 in a measurement temperature range in a range of from 120° C. through 160° C.

5. The toner according to claim 1, wherein a ratio ($P_{urethane}/P_{urea}$) of a peak height due to C═O stretching vibration derived from a urethane bond ($P_{urethane}$) to a peak height due to C═O stretching vibration derived from a urea bond ($P_{ureas}$) in an infrared absorption spectrum of the toner as measured by a KBr method (full transmission method) is in a range of from 9.0 through 23.0.

6. The toner according to claim 1, wherein a toner extract obtained by drying an extraction liquid obtained through Soxhlet extraction of the toner with THF has an acid value AV in a range of from 5 KOHmg/g through 20 KOHmg/g and a hydroxyl value OHV of 20 KOHmg/g or less.

7. The toner according to claim 1, wherein a gel content of insoluble components obtained through Soxhlet extraction of the toner with ethyl acetate is in a range of from 10% by mass through 30% by mass.

8. The toner according to claim 1, wherein a 1/2 method softening point (T1/2) in a flow curve of the toner as measured with an elevated flowtester is in a range of from 105° C. through 125° C.

9. A toner stored unit comprising the toner according to claim 1 stored in the toner stored unit.

10. An image forming apparatus comprising:

an electrostatic latent image bearer;

an electrostatic latent image forming unit configured to form an electrostatic latent image on the electrostatic latent image bearer;

a developing unit containing a toner according to claim 1 and configured to develop the electrostatic latent image with the toner to form a visible image;

a transferring unit configured to transfer the visible image onto a recording medium to form a transferred image; and a fixing unit configured to fix the transferred image on the recording medium.

* * * * *